US012540616B2

(12) United States Patent
Garrison et al.

(10) Patent No.: US 12,540,616 B2
(45) Date of Patent: Feb. 3, 2026

(54) FLUID CYLINDER WITH WEDGE FLANGES

(71) Applicant: GD Energy Products, LLC, Tulsa, OK (US)

(72) Inventors: Jacob Gregory Garrison, Tulsa, OK (US); Paul Douglas Cary, Sapulpa, OK (US); Adam Bradley Avey, Tulsa, OK (US); Konner Casey Kay, Broken Arrow, OK (US)

(73) Assignee: GD ENERGY PRODUCTS, LLC, Tulsa, OK (US)

( * ) Notice: Subject to any disclaimer, the term of this patent is extended or adjusted under 35 U.S.C. 154(b) by 93 days.

(21) Appl. No.: 17/972,702

(22) Filed: Oct. 25, 2022

(65) Prior Publication Data

US 2024/0133375 A1 Apr. 25, 2024
US 2024/0229789 A9 Jul. 11, 2024

(51) Int. Cl.
*F04B 53/16* (2006.01)

(52) U.S. Cl.
CPC ..... *F04B 53/164* (2013.01)

(58) Field of Classification Search
CPC ..... F04B 53/164
See application file for complete search history.

(56) References Cited

U.S. PATENT DOCUMENTS

| | | | | |
|---|---|---|---|---|
| 2,071,825 | A | 2/1937 | Finlayson | |
| 3,655,207 | A | 4/1972 | Schettler | |
| 3,801,234 | A | 4/1974 | Love | |
| 4,467,703 | A | 8/1984 | Redwine | |
| 4,767,276 | A * | 8/1988 | Barnes | F01D 11/006 416/221 |
| 5,451,177 | A * | 9/1995 | Gilman | A63F 7/3622 446/128 |
| 5,799,953 | A | 9/1998 | Henderson | |
| 8,225,694 | B2 | 7/2012 | Kennedy et al. | |
| 8,998,593 | B2 | 4/2015 | Vicars | |
| 9,080,563 | B2 | 7/2015 | Leman | |
| 9,322,402 | B2 | 4/2016 | Marette | |
| 10,260,543 | B2 | 4/2019 | Freed et al. | |
| 10,267,300 | B2 | 4/2019 | Freed et al. | |
| 10,533,750 | B2 | 1/2020 | Garan et al. | |
| 10,941,765 | B2 | 3/2021 | Nowell et al. | |
| 2012/0063936 | A1* | 3/2012 | Baxter | F04B 53/16 417/415 |
| 2014/0322050 | A1 | 10/2014 | Marette et al. | |
| 2017/0211565 | A1* | 7/2017 | Morreale | F04B 39/14 |
| 2019/0178243 | A1 | 6/2019 | Nowell et al. | |
| 2021/0095650 | A1 | 4/2021 | Nowell et al. | |
| 2022/0282720 | A1* | 9/2022 | Foster | F04B 19/22 |

FOREIGN PATENT DOCUMENTS

| | | |
|---|---|---|
| CN | 113483169 A | 10/2021 |

* cited by examiner

*Primary Examiner* — Connor J Tremarche
(74) *Attorney, Agent, or Firm* — Edell, Shapiro & Finnan, LLC

(57) ABSTRACT

A retaining assembly for coupling a fluid end component to a fluid end casing. The retaining assembly includes a pair for clamp members, each of which has a pair of rails that define a wedge-shaped groove therebetween. The groove applying an increasing amount of pre-load force or tension to a flange of the fluid end components and a flange of the fluid end casing to drive them together. The amount of pre-load tension applied can vary and can be determined by the user and amount of tightening of the clamp members.

20 Claims, 22 Drawing Sheets

FLUID CYLINDER WITH WEDGE FLANGES

FIELD OF INVENTION

The present invention relates to the field of high pressure reciprocating pumps and, in particular, to securing a fluid end component to a fluid end casing of a high pressure reciprocating pumps.

BACKGROUND

High pressure reciprocating pumps are often used to deliver high pressure fluids during earth drilling operations. Generally, a reciprocating pump includes a power end and a fluid end. The power end can generate forces sufficient to cause the fluid end to deliver high pressure fluids to earth drilling operations. The fluid end may include a casing that defines one or more internal pumping chambers and conduits that define pathways between one or more internal pumping chambers and external surfaces of the fluid end casing.

Elements are secured to the fluid end casing, and the joints between the elements and the fluid end casing encounter high levels of cyclical stress. Common fluid cylinder designs utilize large threaded retainers to secure elements to the fluid end casing of a fluid end of a reciprocating pump. The threaded retainers engage with threads machined into the fluid cylinder or fluid end casing to load a joint. Those threads are often subject to high levels of cyclical stress, and are typically not pre-loaded correctly in operation, thereby creating opportunity for fatigue failure.

Thus, there is a need for an improved joint between an element and a fluid end casing of a reciprocating pump, and in particular, for a joint between an element and a fluid end casing of a reciprocating pump that can be pre-loaded to improve the performance and lifetime of the joint. There is also a need for a less complex, and more easily serviceable joint.

SUMMARY

The present application relates to techniques for securing one or more fluid end components, such as a stuffing box, against a fluid end casing of a fluid end of a high pressure reciprocating pump and/or against a seal of the fluid end. The techniques may be embodied as a retaining or clamping assembly. Additionally, the techniques may be embodied as one or more methods for securing one or more fluid components to a fluid end casing of a high pressure reciprocating pump.

More specifically, in accordance with at least one embodiment, the present application is directed to a reciprocating pump including a power end and a fluid end. The power end is configured to generate pumping power and the fluid end is configured to deliver a fluid from an inlet bore to an outlet bore as the power end generates the pumping power.

In some embodiments, one or more fluid end components are coupled to the fluid end casing by a retaining or clamping assembly. The invention relates to a retaining assembly for a positive displacement, reciprocating pump that utilizes a particular geometry to secure elements together. The retaining assembly includes a clamp that secures elements together, such as an external fluid end element or component and the fluid end casing of the pump.

In one embodiment, the retaining assembly includes a clamp with a wedge-shaped geometry. A benefit of the wedge-shaped geometry is that it allows the clamp to be pre-loaded to a stress level that is close or similar to the stress level that the joint will experience during operation of the pump. The pre-load stress increases the fatigue life of the parts of a joint significantly. In the present invention, the retaining feature or clamp utilizes a minimal number of connectors due to the mechanical advantage provided by the wedge geometry.

The present invention accomplishes the issue of pre-loading a joint for a fluid end component without threads at the interface of the fluid end component and the casing. The wedge-shaped geometry allows the joint between the elements and the clamp to be pre-loaded to the desired stress.

In one embodiment, the fluid end element or component is a stuffing box that is coupled or secured to the fluid end casing of a reciprocating pump. In particular, the element is coupled to a flange that is formed integrally with a body/casing of the fluid end. In an alternative embodiment, a flange may be bolted to the body/casing of the fluid end, and the element is secured to the bolted flange. The present invention can be used with fluid cylinders in high pressure reciprocating pumps in fracking, drilling, well service, or similar applications.

In one embodiment, a reciprocating pump includes a power end configured to generate pumping power, a fluid end casing having an inlet bore and an outlet bore, the fluid end being configured to deliver a fluid from the inlet bore to the outlet bore as the power end generates the pumping power, the fluid end casing including a first mounting portion, a fluid end component configured to engage the fluid end casing, the fluid end component including a second mounting portion, and a retainer assembly engageable with the first mounting portion and the second mounting portion, the retainer assembly applying a force to each of the first mounting portion and the second mounting portion to press the first mounting portion and the second mounting portion toward each other, the retainer assembly including a pair of spaced apart rails, the pair of spaced apart rails defining a wedge-shaped groove that increases the pressure on the first mounting portion and on the second mounting portion as the retainer assembly is tightened.

In an alternative embodiment, the retainer assembly includes a first clamp member and a second clamp member, the first clamp member includes a body having an inner surface and an outer surface opposite to the inner surface, the inner surface includes the pair of spaced apart rails, the pair of spaced apart rails includes a first rail with a first end and a second rail with a second end, and the first clamp member includes a groove formed between the first rail and the second rail. In another embodiment, the first rail includes a first angled surface, the second rail includes a second angled surface, the groove is located between the first angled surface and the second angled surface, the first angled surface and the second angled surface applying an increasing force to the first mounting portion and to the second mounting portion as the retainer assembly is tightened.

In one embodiment, the first mounting portion of the fluid end casing includes a first flange, the second mounting portion of the fluid end component includes a second flange, and the retainer assembly includes a first clamp member and a second clamp member, each of the first clamp member and the second clamp member includes a first rail and a second rail defining a groove therebetween, the grooves receiving the first flange and the second flange when the clamp members are coupled together, and each of the first clamp member and the second clamp member has a wedge-shaped geometry defining the corresponding groove. In addition, the wedge-shaped geometry of the first clamp member is symmetrical about a longitudinal center plane of the first clamp member, and the wedge-shaped geometry of the second clamp member is symmetrical about the longitudinal center plane of the second clamp member.

In another embodiment, the retainer assembly includes a first clamp member and a second clamp member, the first clamp member has a first rail with a first angled surface and a first curved surface and a second rail with a second angled surface and a second curved surface, and the first angled surface, the first curved surface, the second angled surface, and the second curved surface collectively defining a groove therebetween. In addition, the groove has a lower surface, the lower surface, the first curved surface and the second curved surface collectively defining a lower portion of the groove. Also, the first curved surface of the first rail engages the first mounting portion of the fluid end casing, the second curved surface of the second rail engages the second mounting portion of the fluid end component, and the first curved surface and the second curved surface collectively apply a continuously increasing force on both of the first mounting portion and the second mounting portion as the retainer assembly is tightened. Moreover, an angle of orientation of the first curved surface relative to the lower surface is different than an angle of orientation of the first angled surface relative to the lower surface. In yet another embodiment, the second curved surface is oriented at a same angle relative to the lower surface as the first curved surface, the second angled surface is oriented at a same angle relative to the lower surface as the first angled surface, and the first curved surface and the second curved surface collectively apply more force to the first mounting portion and the second mounting portion than the first angled surface and the second angled surface.

In an alternative embodiment, the fluid end component is a flanged stuffing box, a portion of the stuffing box is locatable in the fluid end casing and the first mounting portion is a first flange coupled to the fluid end housing/casing, the second mounting portion is a second flange extending from the stuffing box, and the retainer assembly couples the first flange to the second flange. In another embodiment, the fluid end casing includes a third mounting portion, the fluid end component is a first fluid end component, and the reciprocating pump includes a second fluid end component configured to engage the fluid end casing, the second fluid end component including a fourth mounting portion, wherein the retainer assembly is engageable with the third mounting portion and the fourth mounting portion simultaneously when the retainer assembly engages the first mounting portion and the second mounting portion, and the retainer assembly applies a force to each of the first mounting portion and the second mounting portion to force the first mounting portion and the second mounting portion together, and applies a force to each of the third mounting portion and the fourth mounting portion to force the third mounting portion and the fourth mounting portion together. The retainer assembly can be placed in a first orientation in which the retainer assembly couples the fluid end component to the fluid end casing, and in a second orientation in which the retainer assembly is tightened to apply a pre-load force to the fluid end casing and the fluid end component.

In another embodiment, a fluid end of a reciprocating pump includes a casing (also referred to herein as a housing and/or main body) defining a fluid cylinder and including a first mounting portion, a fluid end component configured to engage the fluid cylinder, the fluid end component including a second mounting portion, the first mounting portion and the second mounting portion collectively forming a joint, and a coupling assembly that engages the first mounting portion and the second mounting portion, the coupling assembly including a first curved surface portion and a second curved surface portion opposing the first curved surface portion, the first curved surface portion engages the first mounting portion, the second curved surface portion engages the second mounting portion, the first curved surface portion and the second curved surface portion along with a curved lower surface collectively forming a wedge-shaped groove therebetween, and both of the first curved surface portion and the second curved surface portion applying an increasing pre-load compression to the joint formed by the first mounting portion and the second mounting portion as the coupling assembly is tightened from a coupling position to a pre-load applying position.

In an alternative embodiment, the coupling assembly includes a first rail with the first curved surface portion and an opposing second rail with the second curved surface portion, the wedge-shaped groove has a lower point, the distance between the first curved surface portion and the second curved surface portion at a first distance from the lower point is greater than the distance between the first curved surface portion and the second curved surface portion at a second distance from the lower point when the first distance is greater than the second distance. The first mounting portion is a first flange on the fluid end casing, the second mounting portion is a second flange on a removable stuffing box, and the coupling assembly is a pair of arcuate clamps that can be secured together about the first flange and the second flange.

In yet another embodiment, a fluid end of a reciprocating pump includes a casing defining a fluid cylinder and including a first flange extending therefrom, a fluid end component configured to engage the fluid cylinder and including a second flange extending therefrom, and a clamping assembly having a first clamp member and a second clamp member coupleable to the first clamp member, the first clamp member having a first clamp rail and a second clamp rail that define a first wedge-shaped groove therebetween configured to receive the first flange and the second flange, the first clamp rail and the second clamp rail being configured so that the wedge-shaped groove forces the first flange into engagement with the second flange to apply a pre-load force thereto, wherein the amount of pre-load force applied to the first flange and the second flange is determined by how far the first flange and the second flange extend into the wedge-shaped groove.

Alternatively, the first clamp rail includes a first end, a first angled surface and a first compression applying surface, the second clamp rail includes a second end, a second angled surface across the groove from the first angled surface, and a second compression applying surface across the groove from the first compression applying surface, the groove has a lower point, a first distance between the first angled surface and the second angled surface continuously decreases closer to the lower point, and a second distance between the first compression applying surface and the second compression applying surface continuously decreases closer to the lower point, the second distance being less than the first distance.

The first clamp member and the second clamp member are coupled together in a first configuration by at least one connector to secure the first flange and the second flange together, and the first clamp member and the second clamp member are tightened together in a second configuration different from the first configuration to apply a pre-load force to the first flange and the second flange. The fluid end component is a flanged stuffing box, a portion of the stuffing box is locatable in the casing, and the clamping assembly couples the first flange to the second flange.

The foregoing advantages and features will become evident in view of the drawings and detailed description.

BRIEF DESCRIPTION OF THE DRAWINGS

To complete the description and in order to provide for a better understanding of the present application, a set of drawings is provided. The drawings form an integral part of the description and illustrate embodiments of the present application, which should not be interpreted as restricting the scope of the invention, but just as examples. The drawings comprise the following figures.

Like reference numerals have been used to identify like elements throughout this disclosure.

DETAILED DESCRIPTION

The following description is not to be taken in a limiting sense but is given solely for the purpose of describing the broad principles of the invention. Embodiments of the invention will be described by way of example, with reference to the above-mentioned drawings showing elements and results according to the present invention.

Generally, the present application is directed to techniques for securing one or more fluid end components, such as a stuffing box, against a fluid end casing of a high pressure reciprocating pump. The techniques may be embodied as a retaining or clamping assembly. Additionally, the techniques may be embodied as one or more methods for securing one or more fluid end components to a fluid end casing of a high pressure reciprocating pump.

The invention relates to a retaining assembly for a positive displacement, reciprocating pump that utilizes a particular geometry to secure elements together. The retaining assembly includes a clamp that secures elements together, such as an external fluid end element or component and the fluid end casing of the pump. In one embodiment, the retaining assembly includes a clamp with a wedge-shaped geometry. A benefit of the wedge-shaped geometry is that it allows the clamp to be pre-loaded to a stress level that is close or similar to the stress level that the joint will experience during operation of the pump. The pre-load stress increases the fatigue life of the parts of a joint significantly. In the present invention, the retaining feature or clamp utilizes a minimal number of connectors due to the mechanical advantage provided by the wedge geometry.

In one embodiment, the fluid end element or component is a stuffing box that is coupled or secured to the fluid end casing (also referred to as a housing, body, and/or main body) of a reciprocating pump. In particular, the element is coupled to a flange that is formed integrally with a casing of the fluid end. In an alternative embodiment, a flange may be bolted to the casing of the fluid end, and the element is secured to the bolted flange.

Figure 1:
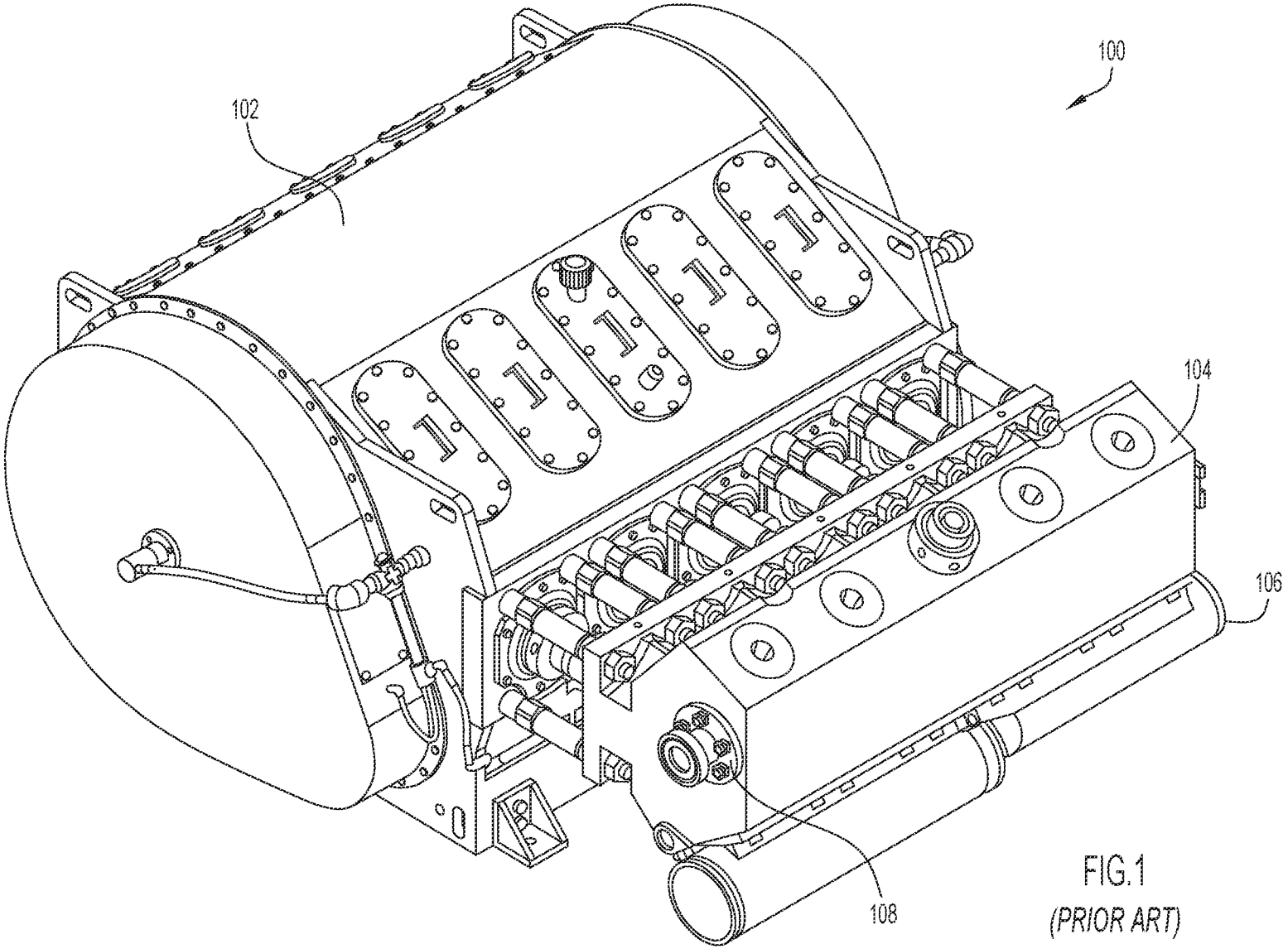
FIG.1 (PRIOR ART)
FIG. 1 is a front perspective view of a prior art reciprocating pump including a fluid end and a power end.

Referring to FIG. 1, a prior art reciprocating pump 100 is illustrated. The reciprocating pump 100 includes a power end 102 and a fluid end 104. The power end 102 includes a crankshaft that drives a plurality of reciprocating plungers or pistons (generally referred to as "reciprocating elements") within the fluid end 104 to pump fluid at high pressure (e.g., to cause the fluid end 104 to deliver high pressure fluids to earth drilling operations). For example, the power end 102 may be configured to support hydraulic fracturing (i.e., fracking) operations, where fracking liquid (e.g., a mixture of water and sand) is injected into rock formations at high pressures to allow natural oil and gas to be extracted from the rock formations. However, to be clear, this example is not intended to be limiting and the present application may be applicable to both fracking and drilling operations. At the same time, the present invention may also offer some specific advantages for hydraulic fracturing, which may be noted herein where applicable.

In any case, often, the reciprocating pump 100 may be quite large and may, for example, be supported by a semi-tractor truck ("semi") that can move the reciprocating pump 100 to and from a well. Specifically, in some instances, a semi may move the reciprocating pump 100 off a well when the reciprocating pump 100 requires maintenance. However, a reciprocating pump 100 is typically moved off a well only when a replacement pump (and an associated semi) is available to move into place at the well, which may be rare. Thus, often, the reciprocating pump is taken offline at a well and maintenance is performed while the reciprocating pump 100 remains on the well. If not for this maintenance, the reciprocating pump 100 could operate continuously to extract natural oil and gas (or conduct any other operation). Consequently, any improvements that extend the lifespan of components of the reciprocating pump 100, extend the time between maintenance operations (i.e., between downtime), and/or minimize the time needed to complete maintenance operations (minimizing downtime) are highly desirable.

Figure 2:
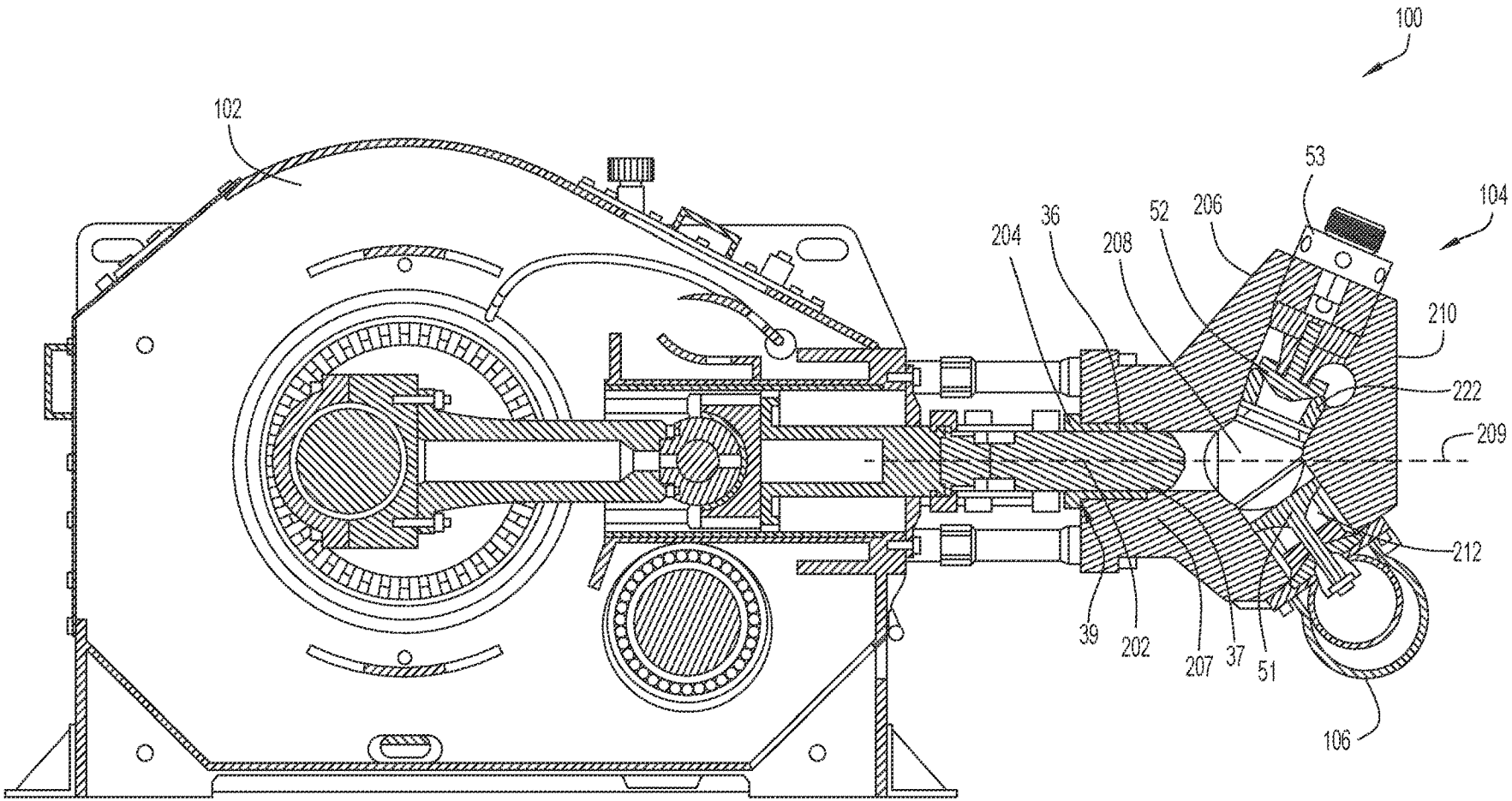
FIG.2 (PRIOR ART)
FIG. 2 is a side cross-sectional view of the prior art reciprocating pump of FIG. 1.

Still referring to FIG. 1, but now in combination with FIG. 2, the reciprocating pump 100 pumps fluid into and out of pumping chambers 208. FIG. 2 shows a side, cross-sectional view of reciprocating pump 100 taken along a central axis 209 of one of the reciprocating elements 202 included in reciprocating pump 100. Thus, FIG. 2 depicts a single pumping chamber 208. However, it should be understood that a fluid end 104 can include multiple pumping chambers 208 arranged side-by-side. In fact, in at least some embodiments (e.g., the embodiment of FIG. 1), a casing 206 of the fluid end 104 forms a plurality of pumping chambers 208 and each chamber 208 includes a reciprocating element 202 that reciprocates within the casing 206. However, side-by-side pumping chambers 208 need not be defined by a single casing 206. For example, in some embodiments, the fluid end 104 may be modular and different casing segments may house one or more pumping chambers 208. In any case, the one or more pumping chambers 208 are arranged side-by-side so that corresponding conduits are positioned adjacent each other and generate substantially parallel pumping action. Specifically, with each stroke of the reciprocating element 202, low pressure fluid is drawn into the pumping chamber 208 and high pressure fluid is discharged. But, often, the fluid within the pumping chamber 208 contains abrasive material (i.e., "debris") that can damage seals formed in the reciprocating pump 100, such as the "packing seals" surrounding a reciprocating element 202 of a fracking fluid end, creating a need for continued maintenance.

In various embodiments, the fluid end 104, and specifically the fluid end casing 206, may be shaped differently and/or have different features, but may still generally perform the same functions, define similar structures, and house similar components. For example, while fluid end 104 includes a first bore 204 that intersects an inlet bore 212 and an outlet bore 222 at skewed angles, other fluid ends may include any number of bores arranged along any desired angle or angles, for example, to intersect bore 204 (and/or an access bore) substantially orthogonally and/or so that two or more bores are substantially coaxial. Generally, bores 212 and 222, as well as any other bores (i.e., segments, conduits, etc.), may intersect to form a pumping chamber 208, may be cylindrical or non-cylindrical, and may define openings at an external surface 210 of the casing 206. Additionally, bores 212 and 222, as well as any other bores (i.e., segments, conduits, etc.), may receive various components or structures, such as sealing assemblies or components thereof.

In the depicted embodiment, inlet bore 212 defines a fluid path through the fluid end 104 that connects the pumping chamber to a piping system 106 delivering fluid to the fluid end 104. Meanwhile, outlet bore 222 allows compressed fluid to exit the fluid end 104. Thus, in operation, bores 212 and 222 may include valve components 51 and 52, respectively, (e.g., one-way valves) that allow bores 212 and 222 to selectively open and deliver a fluid through the fluid end 104. Typically, valve components 51 in the inlet bore 212 may be secured therein by a piping system 106 (see FIG. 1). Meanwhile valve components 52 in outlet bore 222 may be secured therein by a closure assembly 53 that, in the prior art example illustrated in FIG. 2, is removably coupled to the fluid end 104 via threads.

In operation, fluid may enter fluid end 104 via outer openings of inlet bores 212 and exit fluid end 104 via outer openings of outlet bores 222. More specifically, fluid may enter inlet bores 212 via pipes of piping system 106, flow through pumping chamber 208 (due to reciprocation of a reciprocating elements 202), and then flow through outlet bores 222 into a channel 108 (see FIG. 1). However, piping system 106 and channel 108 are merely example conduits and, in various embodiments, fluid end 104 may receive and discharge fluid via any number of pipes and/or conduits, along pathways of any desirable size or shape.

Meanwhile, each of bores 204 defines, at least in part, a cylinder for reciprocating elements 202, and/or connects the casing 206 to a cylinder for reciprocating elements 202. More specifically, in the illustrated embodiment, a casing segment 207 houses a packing assembly 36 configured to seal against a reciprocating element 202 disposed interiorly of the packing assembly 36 and prevent fluid from leaking through reciprocation or reciprocating bore 204. Reciprocation of a reciprocating element 202 in or adjacent to bore 204, which may be referred to as a reciprocation bore (or, for fracking applications, a plunger bore), draws fluid into the pumping chamber 208 via inlet bore 212 and pumps the fluid out of the pumping chamber 208 via outlet bore 222. However, over time, the packing assembly 36 will wear and/or fail, and thus, must be accessed for maintenance and/or replacement. Other components, such as valve components 51 and/or 52, or the fluid end casing 206 itself may also wear and/or fail and require repair or replacement over time. To help provide access to these parts and/or the pumping chamber, some fluid ends have access bores that are often aligned with (and sometimes coaxial with) the reciprocating bore 204. Other fluid ends needs not include access bore and, thus, such an access bore is not illustrated in FIGS. 1 and 2.

Regardless of whether the fluid end includes an access bore, the packing assembly 36 typically needs to be replaced from an outer opening of bore 204 (i.e., a side of bore 204 aligned with the external surface 210 of the casing 206). At the same time, to operate properly, the packing assembly 36 must be securely positioned around the reciprocating element 202, either in or proximate to the reciprocation bore 204. Thus, in many prior art embodiments, the reciprocation bore 204 defines a stuffing box 37, e.g., in the form of a stepped cavity wall. Then, a closure component 39, such as a sleeve or retaining nut, retains the packing assembly 36 (e.g., a set of packing rings) in the stuffing box 37. Alternatively, in some prior art embodiments, a removable stuffing box is removably coupled to a fluid end and defines, or at least partially defines, a stuffing box 37 for a packing assembly 36. However, since the packing assembly 36 often wears much faster than then removable stuffing box, the removably stuffing box must be openable to allow the packing assembly 36 to be replaced or repaired. Thus, removable stuffing boxes are often removably sealed by a component, such as a retaining nut (also referred to as a gland nut) that is removably attachable to the removable stuffing box.

In the former instances (e.g., where a closure component 39 retains the packing assembly 36 in a stuffing box 37 defined by the fluid end 104), the closure component 39 may experience a high load of forces (i.e., high stress). Thus, the closure component 39 must be tightly and securely coupled to the fluid end casing 206, e.g., with threads and/or bolts, and may wear out quickly over time. Meanwhile, in the latter instances (e.g., where a removable stuffing box is removably coupled to a fluid end casing), both the removably stuffing box and the closure component 39 (e.g., a retaining or gland nut) may experience a high load of forces. Thus, the removable stuffing box must be tightly and securely coupled to the fluid end casing 206, e.g., with threads and/or bolts, and the closure component 39 (e.g., a retaining or gland nut) must be tightly and securely coupled to the removable stuffing box. But, even with such connections, portions of the removable stuffing box and the closure component 39 may wear out quickly over time.

Figure 3:
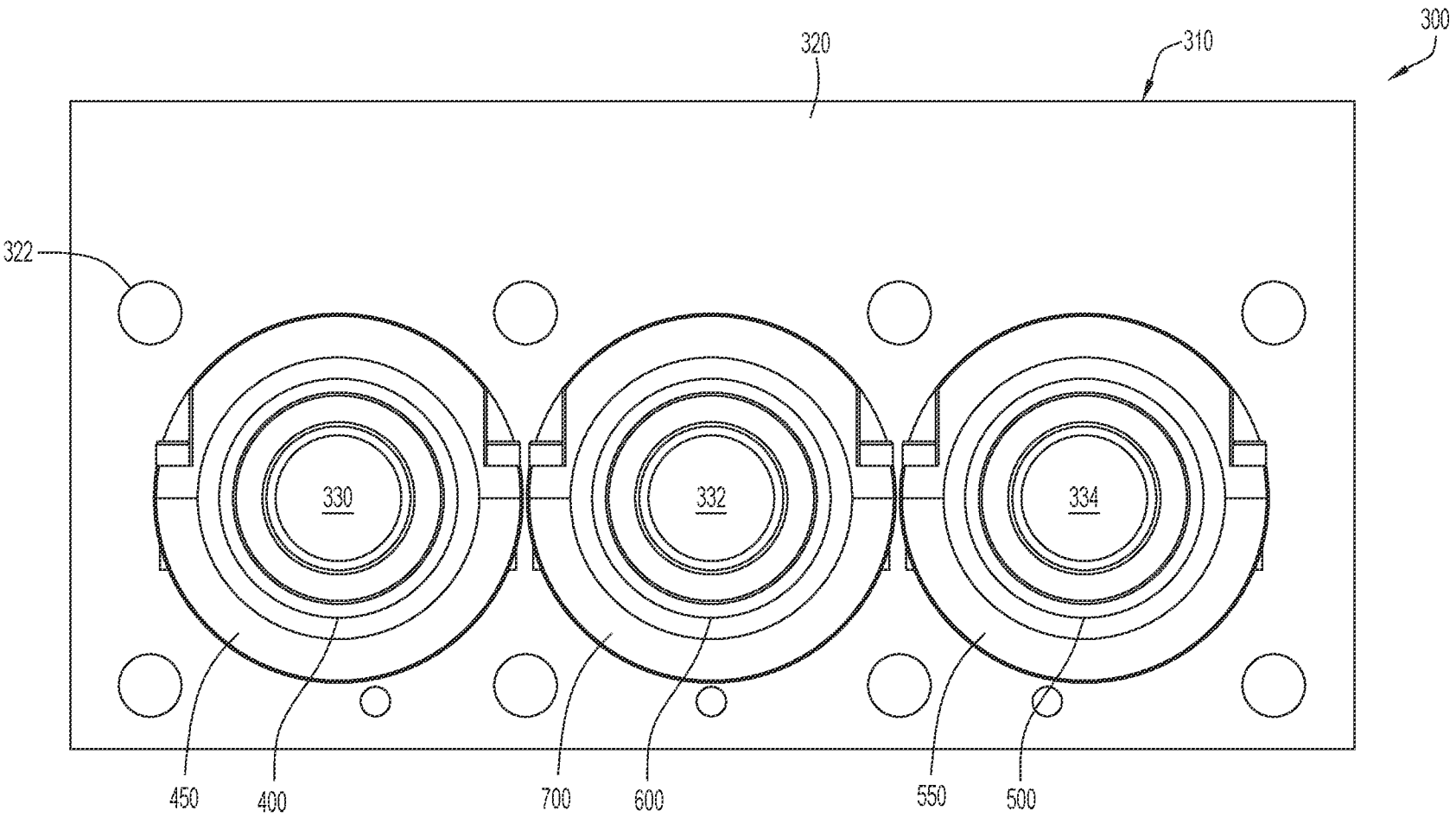
FIG. 3 is a front view of at least a portion of a fluid end of a reciprocating pump according to an example embodiment of the present application.

Now turning to FIG. 3, the present application provides techniques that allow one or more fluid end components to be coupled to a fluid end casing with a reduced amount of stress acting on the components. In FIG. 3, a front view of an embodiment of a fluid end of a reciprocating pump is illustrated. In this embodiment, the reciprocating pump 300 includes a fluid end 310 that has a casing or housing 320. Housing 320 includes several mounting holes 322 that are used to couple or mount the housing 320 to the remainder of the reciprocating pump 300. Housing 320 includes several reciprocating bores 330, 332, and 334 in which reciprocating members, such as pistons or plungers, (not shown) are located.

Coupled to housing 320 are several fluid end components 400, 500, and 600. In one embodiment, the fluid end components 400, 500, and 600 are flanged stuffing boxes, each of which is proximate to and associated with one of the reciprocating bores 330, 334, and 334. Several retaining members 450, 550, and 700 are used to couple respective ones of the fluid end components 400, 500, and 600 to the housing 320. In this embodiment, fluid end component 400 is coupled to housing 320 via retaining member 450, fluid end component 500 is coupled to housing 320 via retaining member 550, and fluid end component 600 is coupled to housing 320 via retaining member 700.

Figure 4:
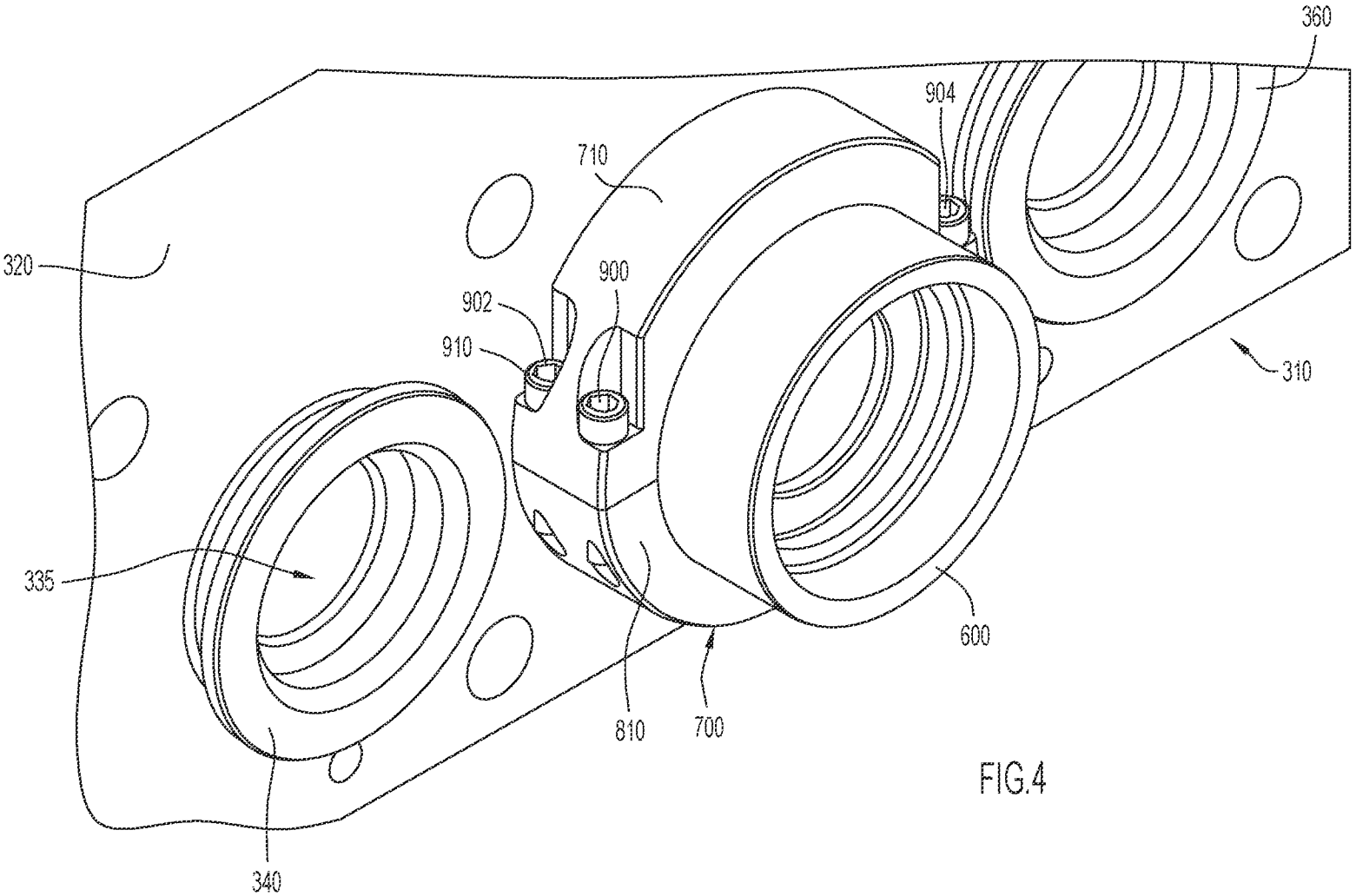
FIG. 4 is a top perspective view of some of the components of the fluid end illustrated in FIG. 3.

Referring to FIG. 4, a top perspective view of a portion of fluid end 310 is illustrated. In this view, fluid end components 400 and 500 and retaining members 450 and 550 are not illustrated to simplify discussion of this embodiment of the invention. The following discussion relating to fluid end component 600 and retaining member 700 relates to fluid end components 400 and 500 and retaining members 450 and 550.

Housing 320 includes a mounting flange or mounting portion 340 coupled thereto. In this embodiment, the mounting portion 340 is integrally formed with housing 320. The mounting portion 340 is aligned with a fluid cylinder 335. Similarly, the mounting flange or mounting portion 360 is coupled to the housing 320, and in this embodiment, is integrally formed with housing 320.

Fluid end component 600 is coupled to housing 320 via retainer assembly 700. The retainer assembly 700 is referred to alternatively as a coupler assembly. In this embodiment, retainer assembly 700 includes a pair of clamp members 710 and 810. Clamp member 710 can be referred to as an upper clamp member, and clamp member 810 can be referred to as a lower clamp member. The clamp members 710 and 810 are coupled to each other by several connectors, of which connectors 902, 904, and 906 are illustrated in FIG. 4. As the connectors are tightened, the clamp members 710 and 810 are coupled to and move closer to each other.

As described in greater detail below, each of the clamp members 710 and 810 has a configuration that enables the tightening of the connectors to initially couple the clamp members 710 and 810 together, and then as the connectors are further tightened, a pre-load force or tension is applied to the fluid end component 600 and a corresponding mounting portion on the housing 320. This feature allows a user to adjust the amount of pre-load or tension applied to the joint formed by the fluid end component and the fluid end housing.

Figure 5:
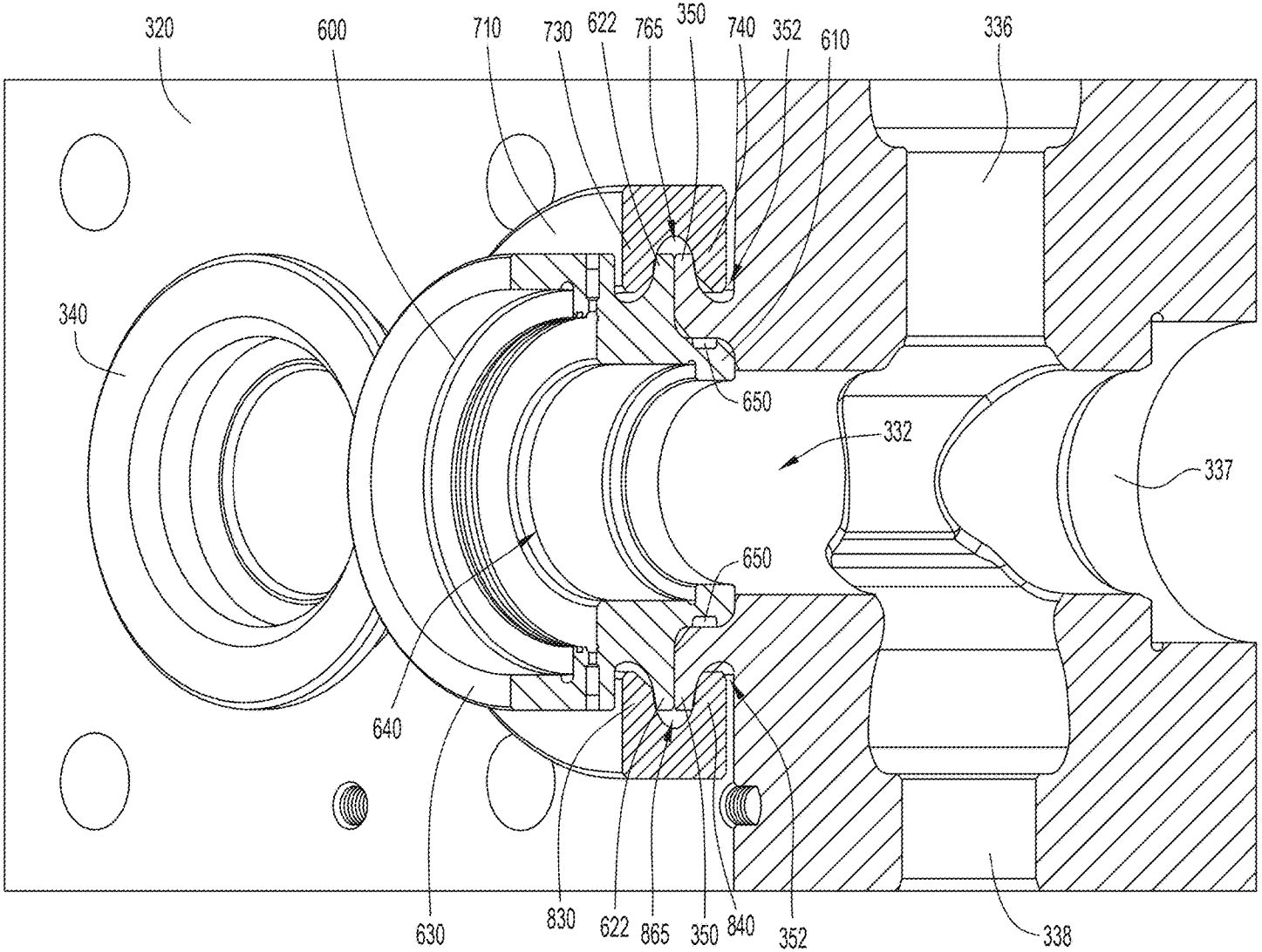
FIG. 5 is a side cross-sectional perspective view of the fluid end illustrated in FIG. 4.

Referring to FIG. 5, a side cross-sectional view of the fluid end housing 320 is illustrated. A few of the bores in the fluid end housing 320 are shown. In particular, fluid end housing 320 includes bores 336, 337, and 338 that are in fluid communication with the reciprocation bore 332.

Fluid end housing 320 includes mounting flange or portion 350, which similar to mounting portions 340 and 360, is formed integrally with housing 320. As shown in FIG. 5, the mounting flange 350 defines a groove 352 between the mounting flange 350 and the outer surface of the housing 320.

As shown in FIG. 4, fluid end component 600 defines a channel 640 that is in fluid communication with reciprocating bore 332. The fluid end component 600 has an outer end portion 630 and an opposite inner end portion 610. The inner end portion 610 is inserted into the channel defined by the mounting portion 350, and is inserted into the fluid cylinder formed in part by the mounting portion 350. Between the outer end portion 630 and the inner end portion 610, the fluid end component 600 includes a coupling or mounting portion that includes a flange portion 622. As shown in FIG. 5, when the fluid end component 600 is coupled to the fluid end housing 320, the flange portion 622 is placed proximate the mounting portion 350 of the fluid end housing 320.

Figure 6:
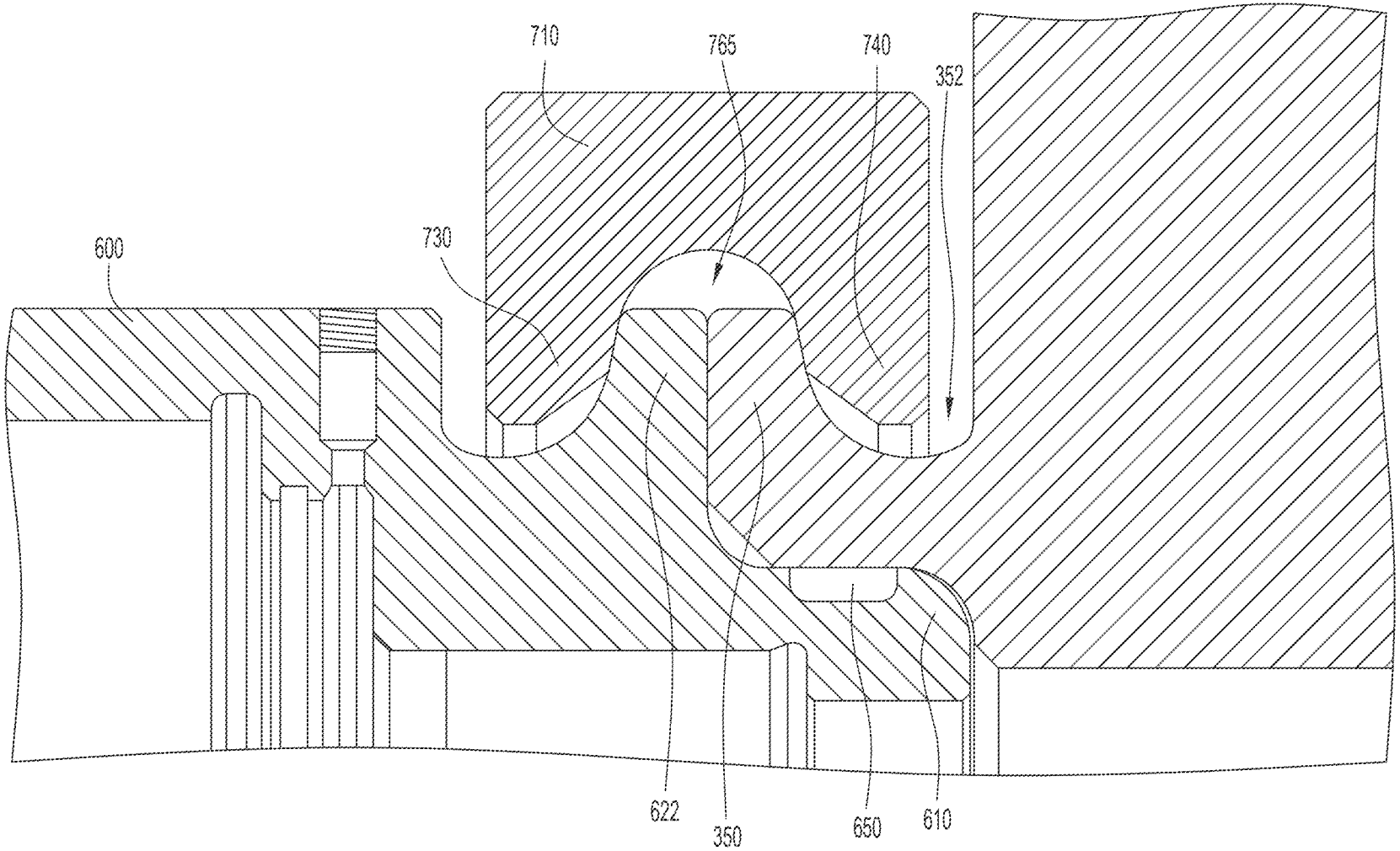
FIG. 6 is a close-up side view of some of the components of the fluid end illustrated in FIG. 5.

Cross-sectional views of each of clamp member 710 and clamp member 810 are illustrated in FIGS. 5 and 6. Clamp members 710 and 810 are configured so that as the connectors are tightened, the clamp members 710 and 810 continuously force flange portion 622 and mounting flange 350 into tighter engagement with each other. As a result, the pre-load force or tension applied to the joint of the flange portion 622 and the mounting portion 350 can be varied by adjusting the tightness of the connectors because the clamp members 710 and 810 are shaped to continuously force the flange portion 622 and the mounting portion 350 together.

Clamp member 710 includes a first ridge or rail 730 and a second ridge or rail 740 that define a groove 765 therebetween. As illustrated, groove 765 is wedge-shaped. Similarly, clamp member 810 includes a first ridge or rail 830 and a second ridge or rail 840 that define a groove 865 therebetween. Groove 865 is also a wedge-shaped groove. First rails 730 and 830 are aligned with each other when the ends of clamp members 710 and 810 are placed in contact with each other. Similarly, second rails 740 and 840 are aligned with each other when the ends of clamp members 710 and 810 are placed in contact with each other. First rails 730 and 830 engage with an outer groove formed in the fluid end component 600. Second rails 740 and 840 engage with the groove 352 formed by the mounting flange 350.

As shown in FIGS. 5 and 6, the fluid end component 600 includes a groove that includes a sealing element 650, which is made of an elastomeric material. The sealing element 650 prevents debris from entering the fluid end housing 320 along the surface of the fluid end component 600.

Figure 7A:
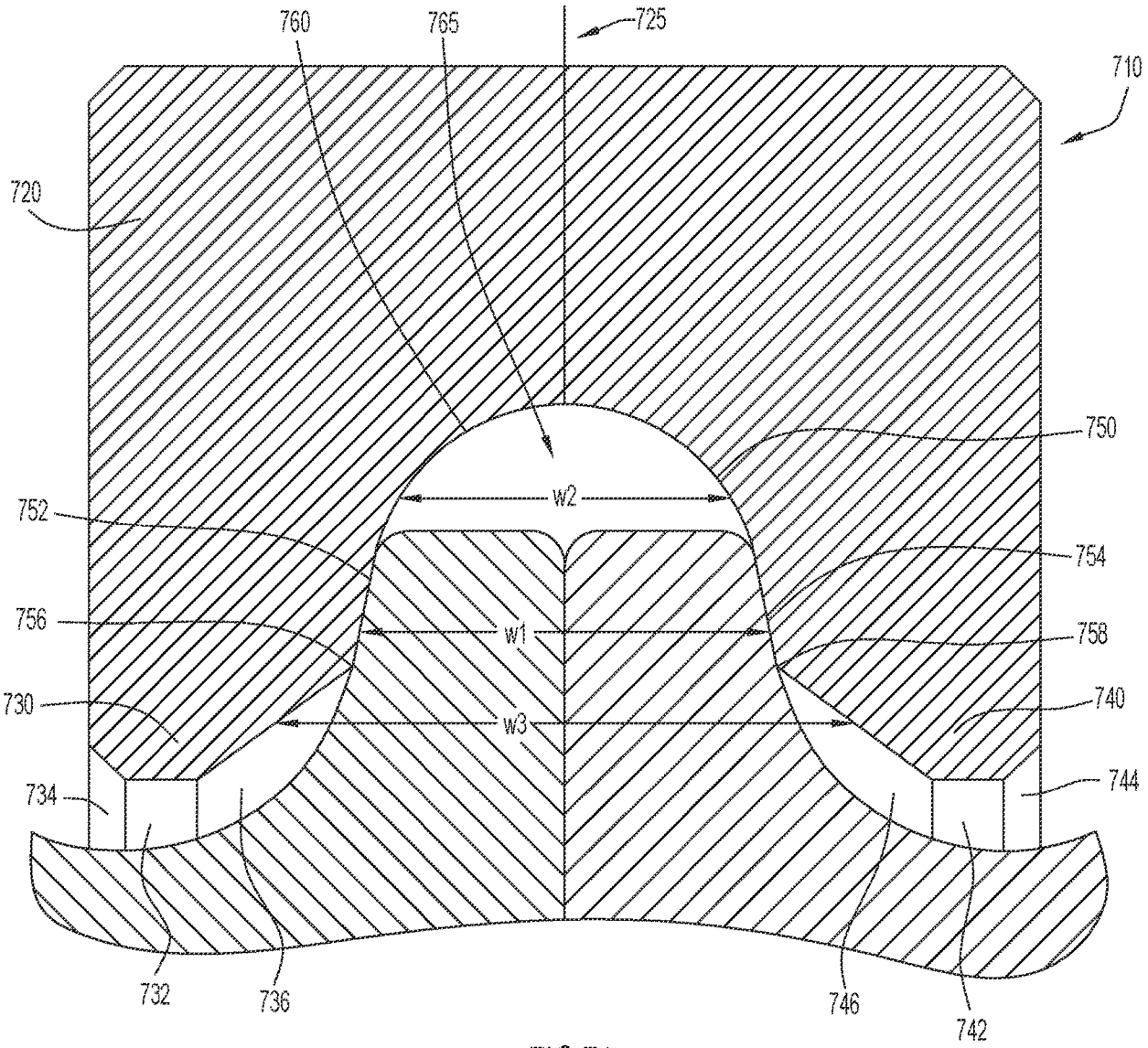
FIG. 7A is close-up cross-sectional perspective view of a retaining assembly component illustrated in FIG. 6.

Turning to FIG. 7A, a close-up view of an embodiment of clamp member 710 according to the present invention is illustrated. The following discussion of the features of clamp member 710 applies to the similar features of clamp member 810. For simplicity of discussion, only clamp member 710 is discussed in detail. Clamp member 710 has a body 720 that includes rails 730 and 740. Rail 730 includes an end 732 that has an outer angled surface 734 on one side and an inner angled surface 736 on another side. Similarly, rail 740 includes an end 742 that has an outer angled surface 744 on one side and an inner angled surface 746 on another side.

Angled surface 736 is oriented at an angle (and angle of orientation) with respect to a longitudinal center plane 725 of the clamp member 710 as well as with respect to a lower surface of the groove. Angled surface 746 is also oriented at an angle with respect to plane 725, and in particular, at the same angle as angled surface 736. In other words, angled surface 746 is symmetrical about plane 725 with angled surface 736. When the flange 622 and the mounting portion 350 are placed proximate each other, the flange 622 engages angled surface 736 and mounting portion 350 engages angled surface 746. As the clamp members 710 and 810 are tightened, the angles of inclination of the angled surfaces 736 and 746 force or drive the flange 622 and mounting portion 350 together.

Clamp member 710 includes a curved surface 750 that has a portion 752 on rail 730 and an opposite portion 754 on rail 740. The curved surface 750 extends to end 756 proximate angled surface 736 and to end 758 proximate angled surface 746. As shown in FIG. 7A, the distance between the opposite sides of the curved surface 750 varies closer to the bottom end or lower surface of the groove 765. At one point, the distance w1 between side portions 752 and 754 is longer than the distance w2 between side portions 752 and 754 at a location closer to the bottom end or portion 760 of the groove 765. Also shown in FIG. 7A is how the distance w3 between opposite angled surfaces 736 and 746 is greater than any distance between side portions 752 and 754. As a result of the decreasing width, when the flange 622 and mounting portion 350 are engaged by the side portions 752 and 754, they are forced together more by the side portions 752 and 754 the deeper into the groove 765 the flange 622 and mounting portion 350 are positioned. The tightening of the clamp members 710 and 810 force the flange 622 and mounting portion 350 further into the groove 765, and thereby increasing the pre-load force or tension on them.

Figure 7B:
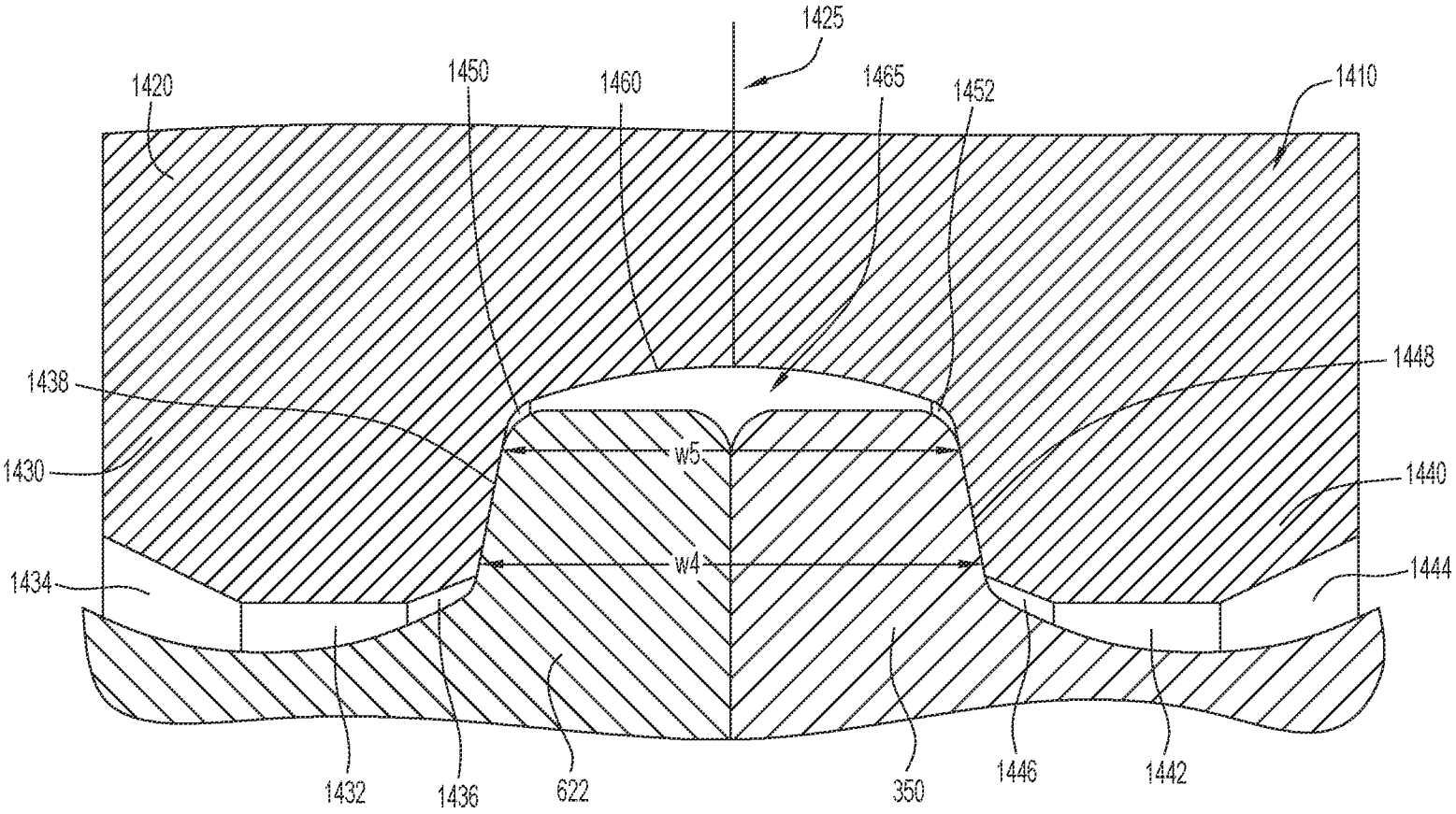
FIG. 7B is a close-up cross-sectional perspective view of a retaining assembly component that can be used with a fluid end of a reciprocating pump according to an alternative embodiment of the present invention.

Turning to FIG. 7B, a close-up view of an alternative embodiment of a clamp member according to the present invention is illustrated. The illustrated clamp member is an alternative embodiment of the clamp member illustrated in FIG. 7A. Clamp member 1410 couples flange portions 350 and 622 together, and applies a compressive force or tension on flange or mounting portions 350 and 622 as clamp member 1410 is tightened.

Clamp member 1410 has a body 1420 that includes rails 1430 and 1440 and a groove 1465 between the rails 1430 and 1440. In this embodiment, the groove 1465 has a wedge-shape. Rail 1430 includes an end 1432 that has an outer angled surface 1434 on one side and an inner angled surface 1436 on another side. Similarly, rail 1440 includes an end 1442 that has an outer angled surface 1444 on one side and an inner angled surface 1446 on another side. As can be appreciated from FIGS. 7A and 7B, the sizes of the ends 1432 and 1442 and the angled surfaces 1434, 1436, 1444, and 1446 can vary in different embodiments.

Angled surface 1436 is oriented at an angle (and angle of orientation) with respect to a longitudinal center plane 1425 of the clamp member 1410 as well as with respect to a lower surface 1460 of the groove 1465. Angled surface 1446 is also oriented at an angle with respect to the center plane, and in particular, at the same angle as angled surface 1436. Thus, angled surface 1446 is symmetrical about plane 1425 with angled surface 1436. When the flange 622 and the mounting portion 350 are placed proximate each other, the flange 622 engages angled surface 1436 and mounting portion 350 engages angled surface 1446. As the clamp members are tightened, the angles of inclination of the angled surfaces 1436 and 1446 force or drive the flange 622 and mounting portion 350 together.

As shown in FIG. 7B, rail 1430 includes another angled inner surface 1438 and rail 1440 has another angled inner surface 1448 corresponding to inner surface 1438. The angled inner surfaces 1438 and 1448 terminate in curved surfaces 1450 and 1452, respectively. As shown in FIG. 7B, the distance between the angled inner surfaces 1438 and 1448 varies closer to the bottom end or lower surface 1460 of the groove 1465. At one point, the distance w4 between angled inner surfaces 1438 and 1448 is longer than the distance w5 between at a location closer to the bottom end 1460 of the groove 1465. As a result of the decreasing width, when the flange 622 and mounting portion 350 are engaged by the angled inner surfaces 1438 and 1448, they are forced together more by the angled inner surfaces 1438 and 1448 the deeper into the groove 1465 that the flange 622 and mounting portion 350 are positioned. In this embodiment, the angle of inclination of inner surfaces 1438 and 1448 matches the outer surface profiles of flange 622 and mounting portion 350, respectively, thereby facilitating the movement of the flange 350 and 622 into the groove 1465. The tightening of the clamp members forces the flange 622 and mounting portion 350 further into the groove 1465, and thereby increasing the pre-load force or tension on them.

Figure 8:
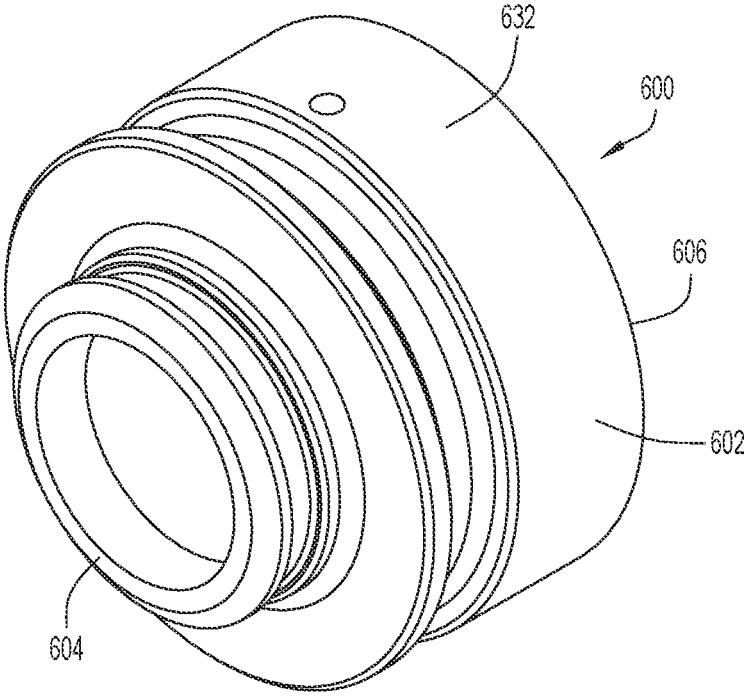
FIG. 8 is a perspective view of at least a portion of a fluid end component according to an example embodiment of the present application.
Figure 9:
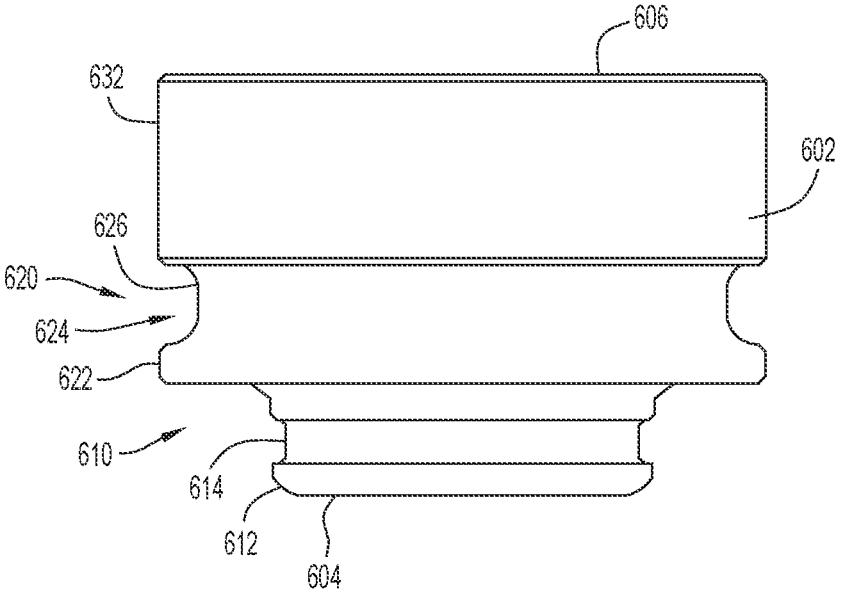
FIG. 9 is a top view of the fluid end component illustrated in FIG. 8.

Referring to FIGS. 8-11, several views of an embodiment of a fluid end component according to the present invention are illustrated. As shown in FIG. 8, the body 602 of fluid end component 600 that has an inner end 604 and an opposite outer end 606, and an outer surface 632. Referring to FIG. 9, along the outer surface 632 is a coupling or mounting portion 620, which includes flange or flange portion 622, as described above. The flange portion 622 forms a groove 624 with a surface 626. The inner end portion 610 includes a flange 612 that defines a groove 614 into which sealing element 650 is placed. The groove 614 is defined by surface 616.

Figure 10:
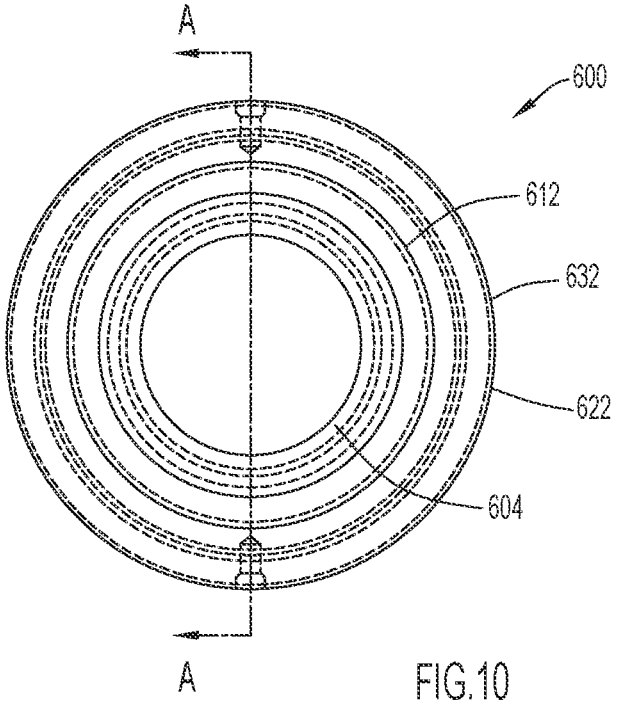
FIG. 10 is an end view of the fluid end component illustrated in FIG. 8.
Figure 11:
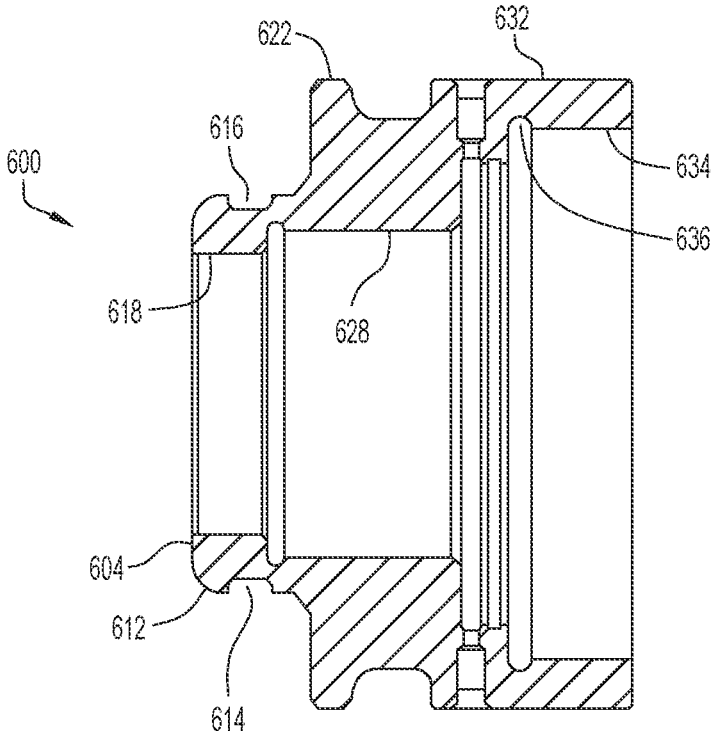
FIG. 11 is a side cross-sectional view of the fluid end component illustrated in FIG. 8 taken along the line "A-A" of FIG. 10.

Referring to FIGS. 10 and 11, the outer diameters of the different parts of the fluid end component 600 are shown. The outer surface of flange portion 622 and outer surface 632 have similar outer diameters, and the outer end of flange 612 has a smaller outer diameter. The inner surfaces of the fluid end component 600 are illustrated in FIG. 11. In particular, fluid end component 600 includes inner surfaces 618, 628, and 634 and inner groove 636, which are used for various internal components of fluid end 310.

Figure 12:
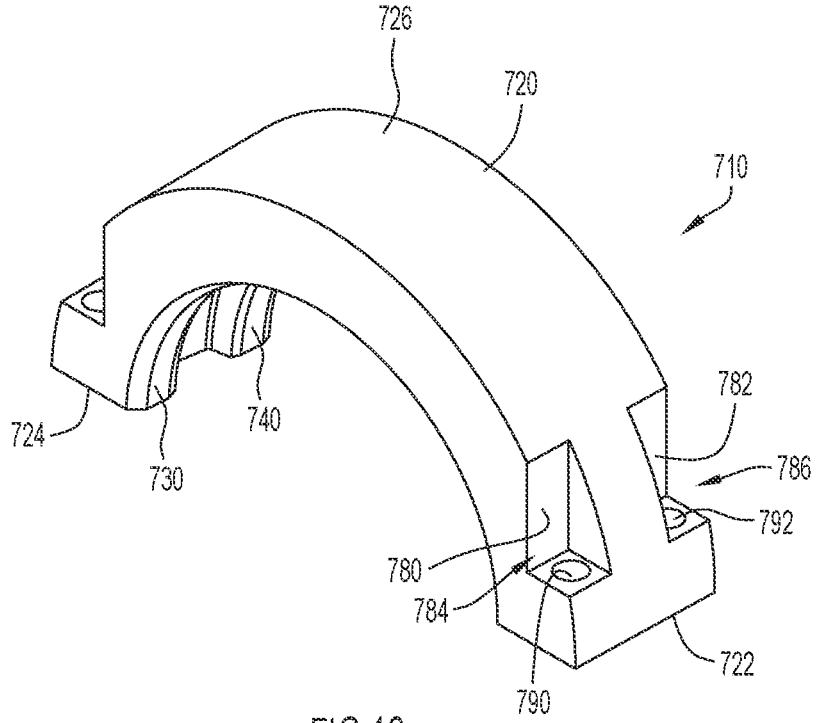
FIG. 12 is a perspective view of a retaining assembly component according to an example embodiment of the present application.
Figure 13:
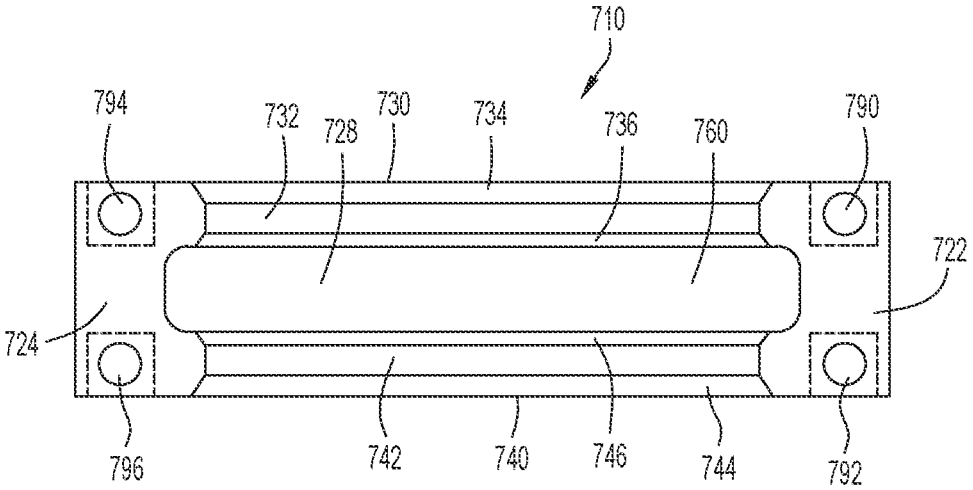
FIG. 13 is a bottom view of the retaining assembly component illustrated in FIG. 12.
Figure 14:
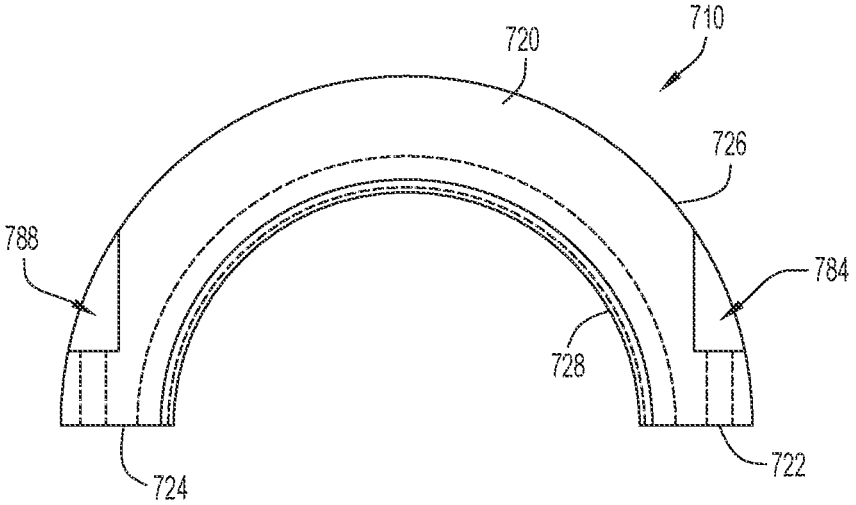
FIG. 14 is a side view of the retaining assembly component illustrated in FIG. 12.
Figure 15:
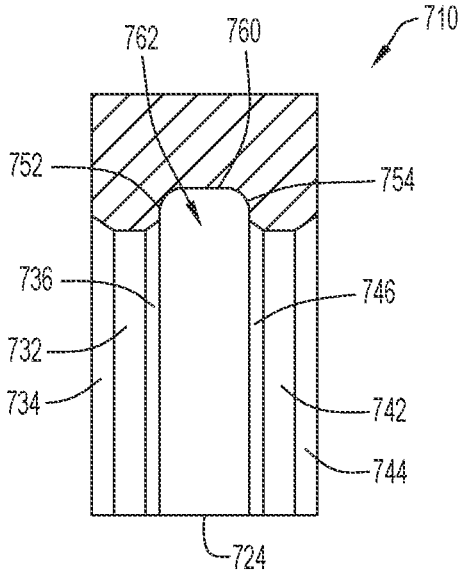
FIG. 15 is an end cross-sectional view of the retaining assembly component illustrated in FIG. 12 taken along the line "A-A" of FIG. 14.

Referring to FIGS. 12-15, several views of an embodiment of a clamp member according to the present invention are illustrated. As shown in FIG. 12, the clamp member 710 includes a body 720 with an outer surface 726 and opposite ends 722 and 724. The inner surface 728, which is opposite the outer surface 726, is illustrated in FIG. 13. Formed proximate ends are notches that facilitate the insertion of connectors. Body 720 includes notches 784 and 786 that are formed by walls 780 and 782. Each notch is sized to receive the head of a connector (such as head 910 of connector 902 in FIG. 4). Referring back to FIG. 13, notches 784 and 786 include holes 790 and 792, respectively, into which connectors are inserted. A bottom view of the clamp member 710 is shown in FIG. 13, and the various surfaces of rails 730 and 740 discussed above are illustrated. The ends 722 and 724 and the four connector holes 790, 792, 794, and 796 are shown as well. An additional notch 788 is illustrated in FIG. 14.

Figure 16:
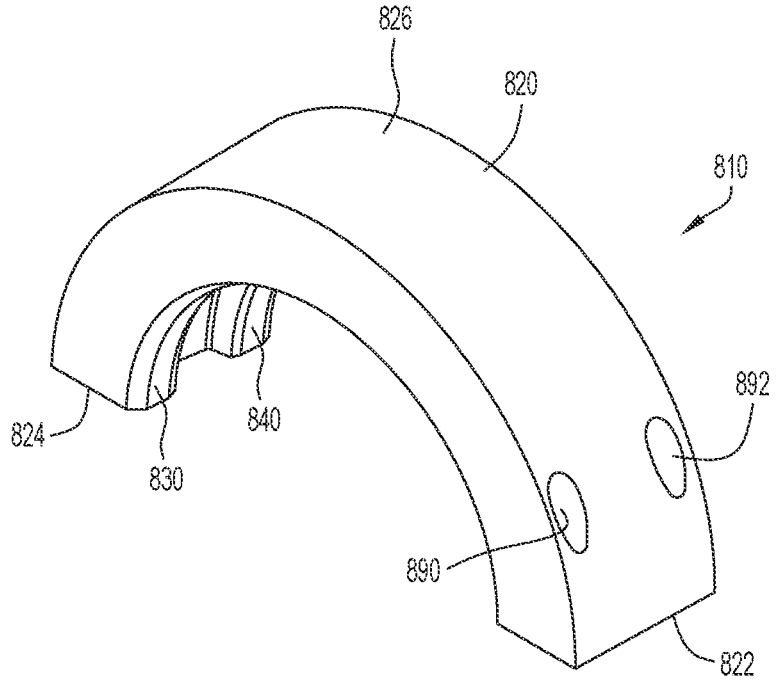
FIG. 16 is a perspective view of another retaining assembly component according to an example embodiment of the present application.
Figure 17:
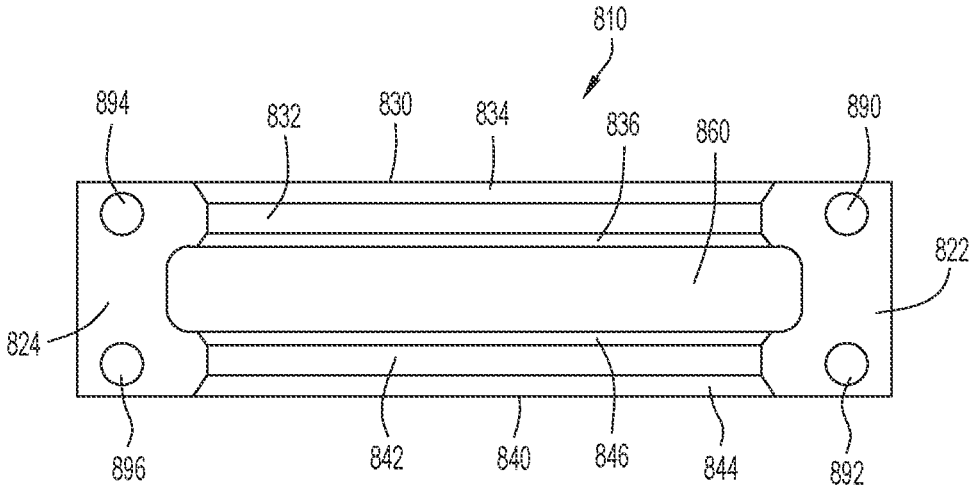
FIG. 17 is a bottom view of the retaining assembly component illustrated in FIG. 16.
Figure 18:
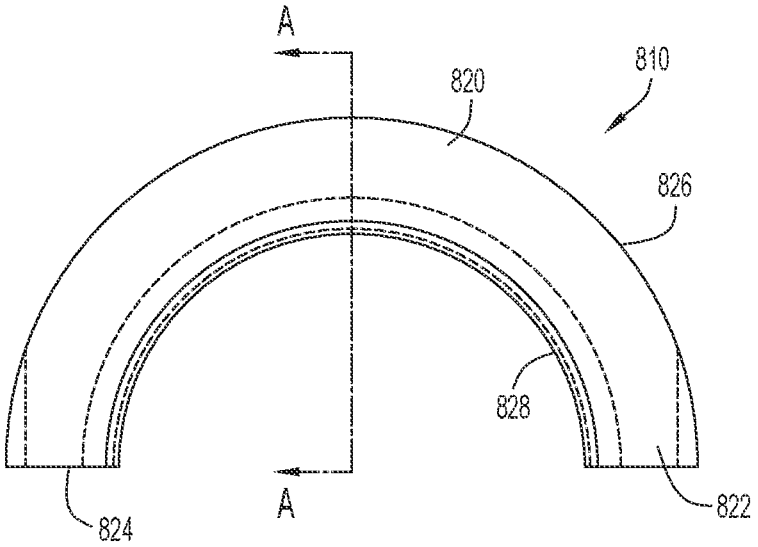
FIG. 18 is a side view of the retaining assembly component illustrated in FIG. 16.

Referring to FIGS. 16-19, several views of another embodiment of a clamp member according to the present invention are illustrated. Referring to FIG. 16, the clamp member 810 includes a body 820 with an outer surface 826, an inner surface 828 opposite outer surface 826, and opposite ends 822 and 824 (see also FIG. 17). A bottom view of the clamp member 810 is shown in FIG. 17, and the various surfaces of rails 830 and 840 are illustrated. Rail 830 includes an end 832, and angled surfaces 834 and 836 on opposite sides of end 832. Similarly, rail 840 includes an end 842, and angled surfaces 844 and 846 on opposite sides of end 842. Between the rails 830 and 840 is a bottom portion 860 of groove 865. The four holes 890, 892, 894, and 896 for the connectors are illustrated in FIG. 17.

Figure 19:
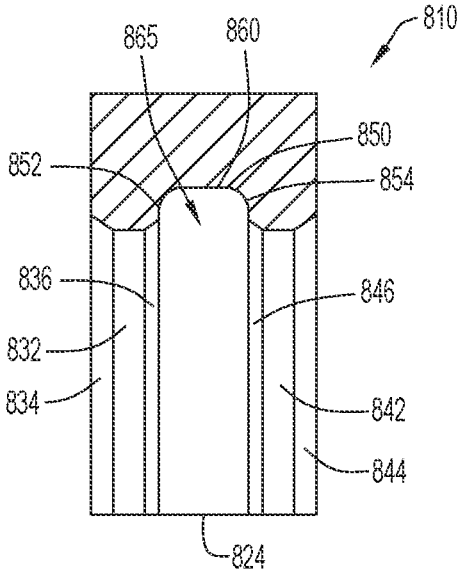
FIG. 19 is an end cross-sectional view of the retaining assembly component illustrated in FIG. 16 taken along the line "A-A" of FIG. 18.

Referring to the cross-sectional view of clamp member 810 in FIG. 19, the curved surface 850 that defines groove 865 is illustrated. Similar to curved surface 750, the curved surface 850 of clamp member 810 includes opposite side portions 852 and 854.

Figure 20:
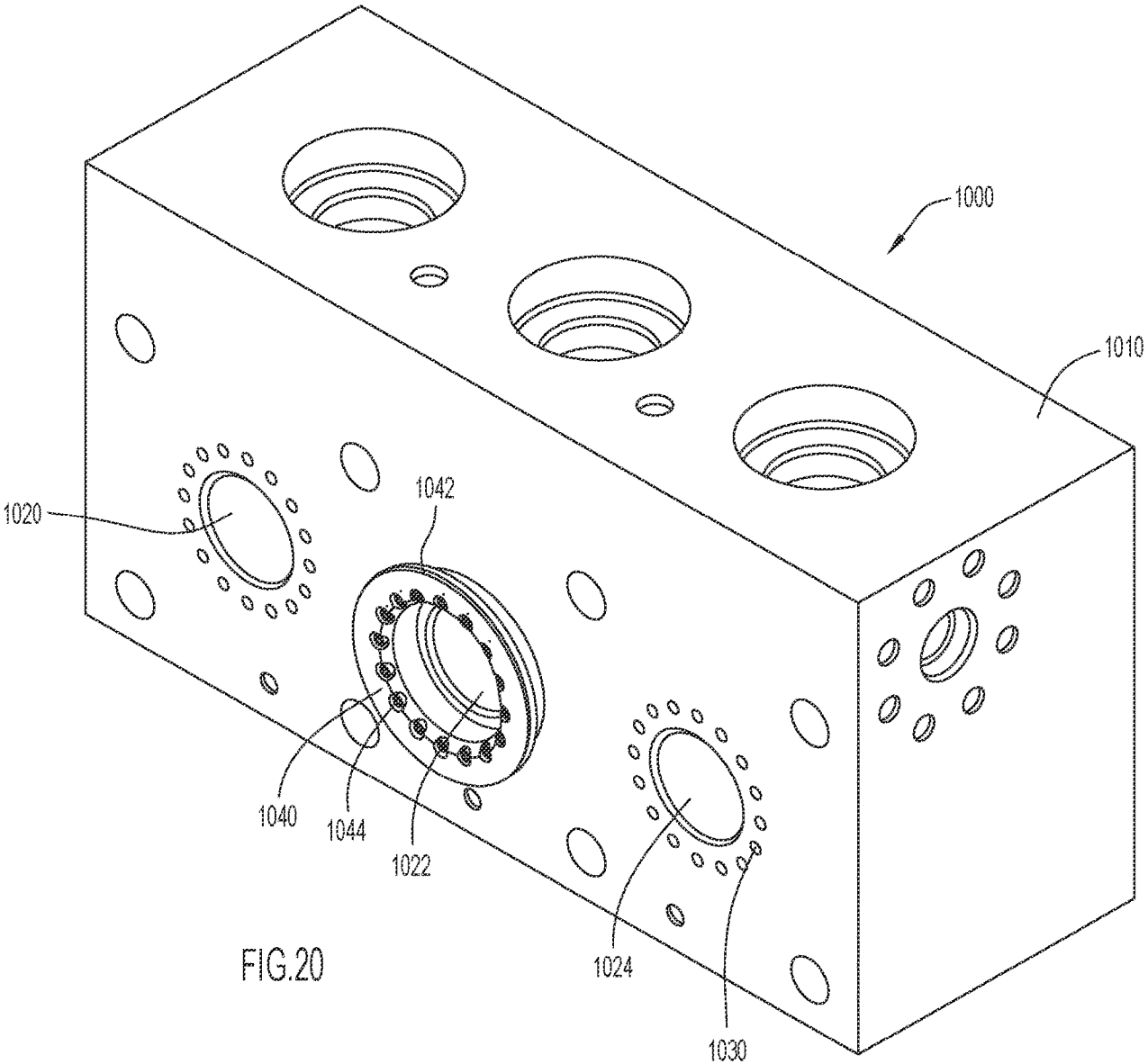
FIG. 20 is a top perspective view of at least a portion of a fluid end of a reciprocating pump according to another example embodiment of the present application.
Figure 21:
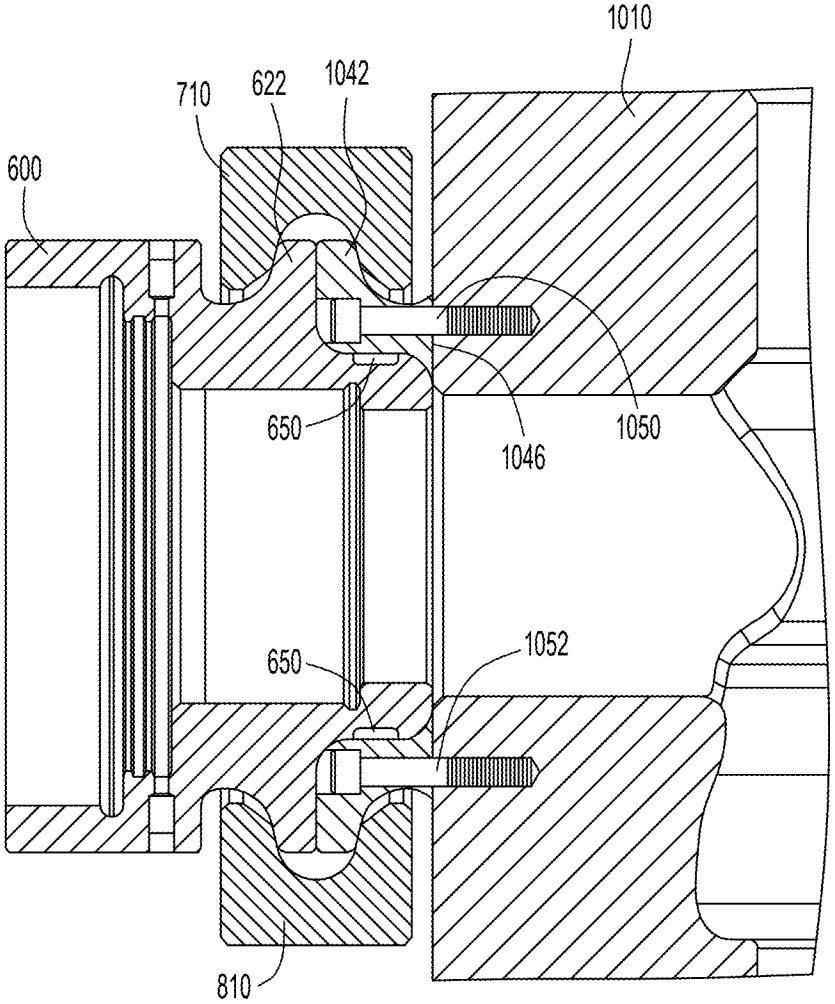
FIG. 21 is a side cross-sectional view of a fluid end component coupled by a retaining assembly coupled to the fluid end illustrated in FIG. 20.

Referring to FIGS. 20 and 21, at least a portion of another embodiment of a fluid end according to the present invention is illustrated. The fluid end 1000 includes a casing or housing 1010 with multiple reciprocation bores 1020, 1022, and 1024. In this embodiment, the mounting portion or component 1040 is formed separately from the housing 1010 and is coupled or mounted to the housing 1010. While only mounting portion 1040 is illustrated, mounting portions or components are placed into engagement with reciprocation bores 1020 and 1024, but not illustrated in FIG. 20 for ease of discussion. Each of the reciprocation bores 1020, 1022, and 1024 includes several smaller holes 1030 surrounding the bores. The smaller holes 1030 are sized to receive connectors, such as bolts, that are used to couple the mounting portions to the fluid end housing 1010. The mounting portion 1040 includes a mounting flange 1042 and several mounting holes 1044 that are sized to receive connectors that engage holes 1030.

Referring to FIG. 21, a side cross-sectional view of the portion of the fluid end illustrated in FIG. 20 is shown. Clamp members 710 and 810 are forcing flange 622 and flange portion 1042 together. Connectors 1050 and 1052 are exemplary of the numerous connectors that couple the mounting component 1040 to the fluid end housing 1010 such that the end surface 1046 of the mounting component 1040 is in contact with the housing 1010. Similarly to as shown in FIGS. 5 and 6, the fluid end component 600 includes a groove that includes the sealing element 650, which is made of an elastomeric material.

Figure 23:
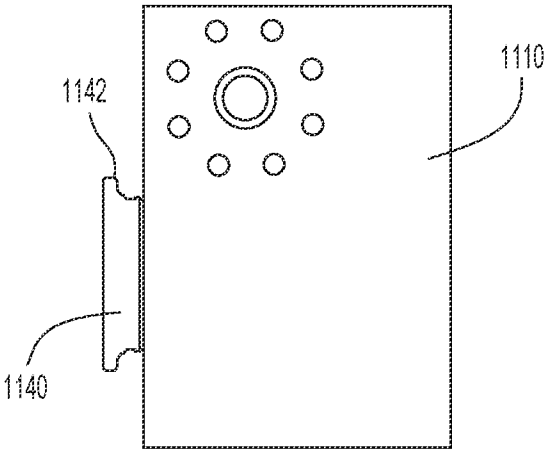
FIG. 23 is a side view of the fluid end illustrated in FIG. 22
Figure 22:
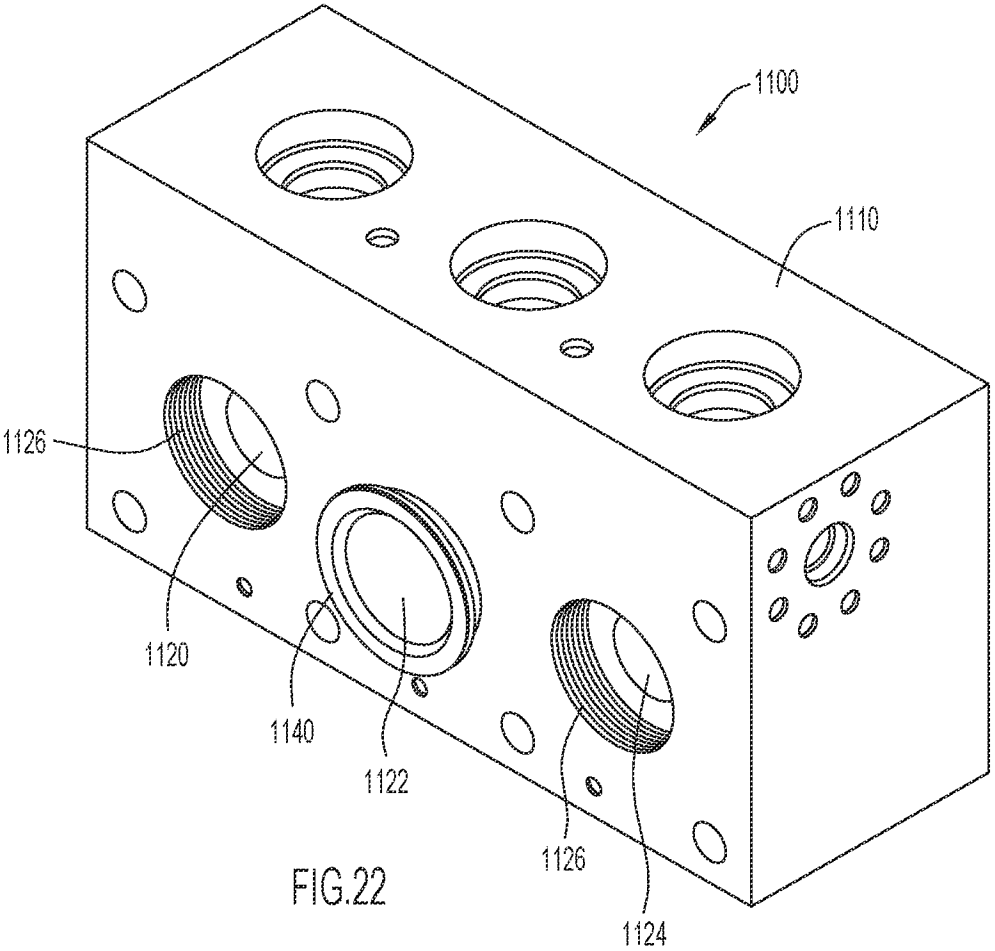
FIG. 22 is a top perspective view of at least a portion of a fluid end of a reciprocating pump according to another example embodiment of the present application.

Referring to FIGS. 22-25, another embodiment of a fluid end housing according to the present invention is illustrated. In this embodiment, fluid end housing 1100 includes several reciprocation bores 1120, 1122, and 1124, each of which has threads 1126 formed therein (see FIGS. 22 and 24). In this embodiment, mounting component 1140 is formed separately from the housing 1100 and coupled thereto. As shown in FIG. 23, the mounting component 1140 includes a flange portion 1142 that is used to couple a fluid end component to the fluid end housing 1100.

Figure 25:
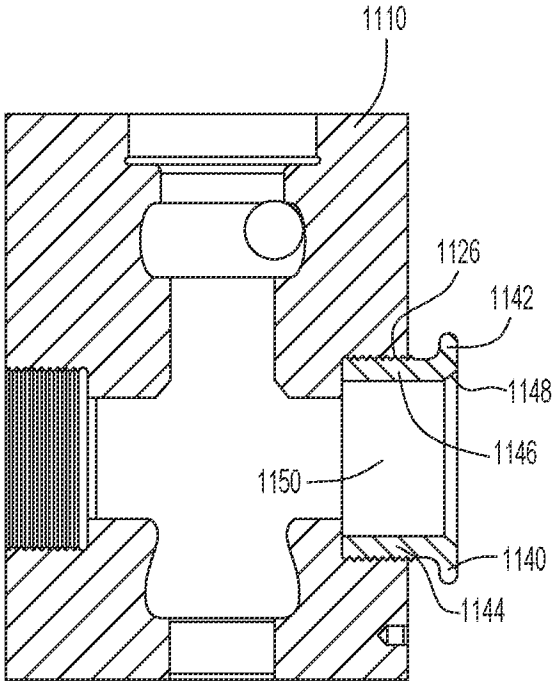
FIG. 25 is a side cross-sectional view of the fluid end illustrated in FIG. 22 taken along the line "B-B" of FIG. 24.
Figure 24:
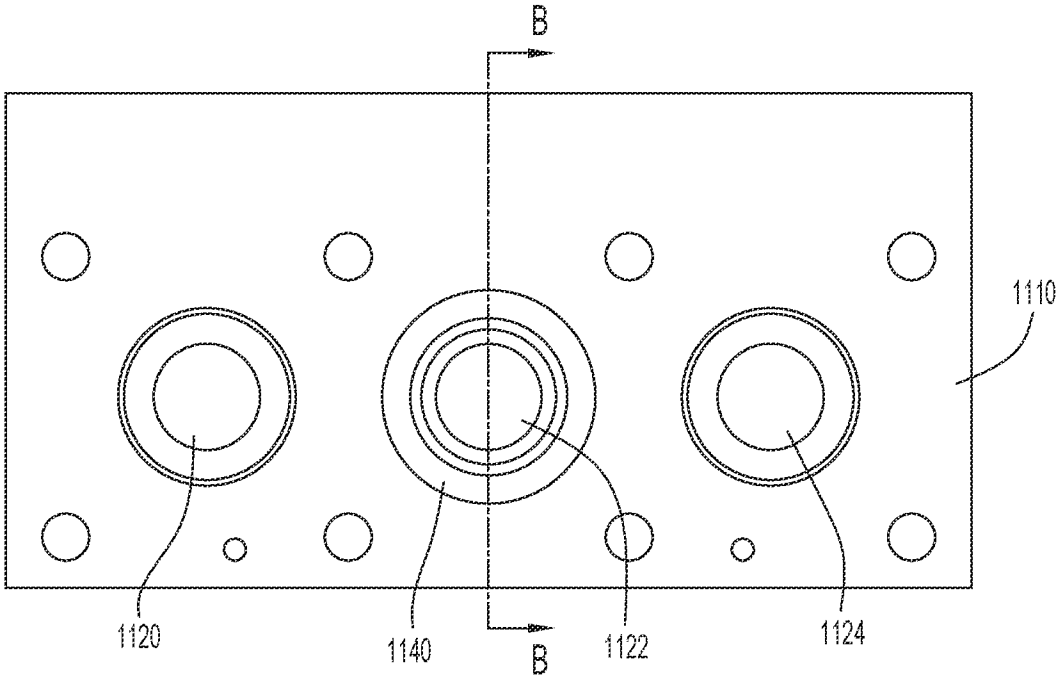
FIG. 24 is a front view of the fluid end illustrated in FIG. 22.

Referring to FIG. 25, a cross-sectional view of the mounting component 1140 is illustrated. Mounting component 1140 includes a body portion 1144 with threads 1146 on the outer surface thereof. The threads 1146 are engageable with the threads 1126 in bore 1122. The mounting component 1140 is inserted into bore 1122 and rotated into a secured position via threads 1126 and 1146. In this embodiment, the mounting component 1140 includes a channel 1150 and a tapered surface 1148 that receives a portion of a fluid end component.

Figure 26:
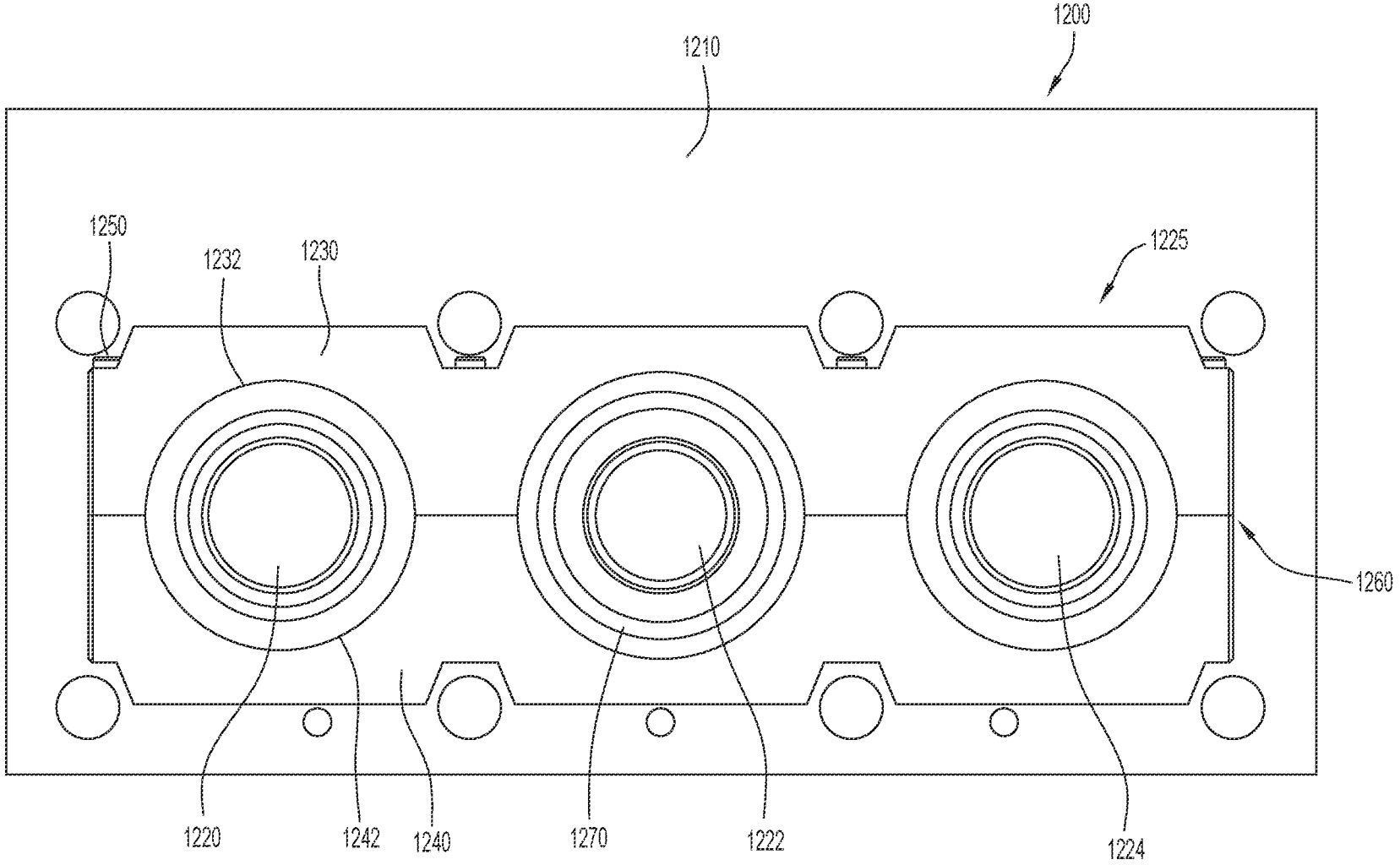
FIG. 26 is a front view of at least a portion of a fluid end of a reciprocating pump according to another example embodiment of the present application.
Figure 28:
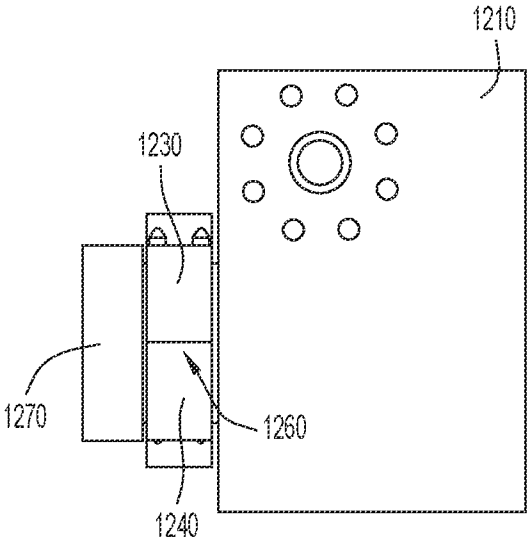
FIG. 28 is a side view of the fluid end illustrated in FIG. 26.
Figure 27:
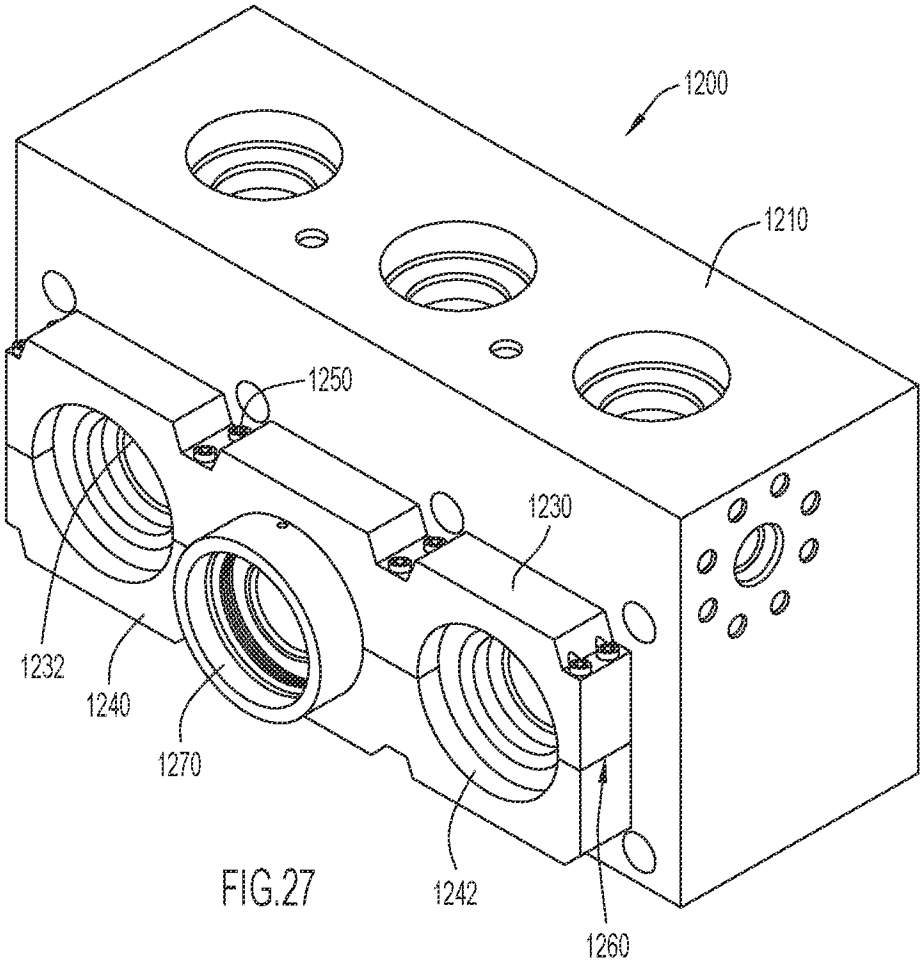
FIG. 27 is a top perspective view of the fluid end illustrated in FIG. 26.

Referring to FIGS. 26-28, at least a portion of another embodiment of a fluid end according to the present invention is illustrated. In this embodiment, fluid end 1200 includes a casing or housing 1210 that has several reciprocation bores 1220, 1222, and 1224. While only three bores are illustrated in FIG. 26, in other embodiments, the quantity of reciprocation bores can vary and be more or less than three. In addition, while only one fluid end component 1270 is illustrated in FIG. 26 relative to bore 1222, it is to be appreciated that fluid end components can be coupled to the housing 1210 proximate bores 1220 and 1224.

In this embodiment, instead of separate retaining or clamping assemblies for each fluid end component, one retaining or clamping assembly is provided for all of the fluid end components. Retaining assembly 1225 includes a pair of clamp members 1230 and 1240, each of which includes several recesses 1232 and 1242 that are aligned with bores 1220, 1222, and 1224 and sized to receive fluid end components. The clamp members 1230 and 1240 are coupled together via several connectors 1250, such as screws or bolts. In a manner similar to previous embodiments of clamp members described herein, the increased tightening of the connectors 1250 that couple clamp members 1230 and 1240 together will force the flanges of the fluid end component and the fluid end housing together more and more.

As shown in FIGS. 26-28, the ends of the clamp members 1230 and 1240 are proximate each other. Depending on how tightly the clamp members 1230 and 1240 are coupled together, a gap 1260 may exist between them.

Figure 30:
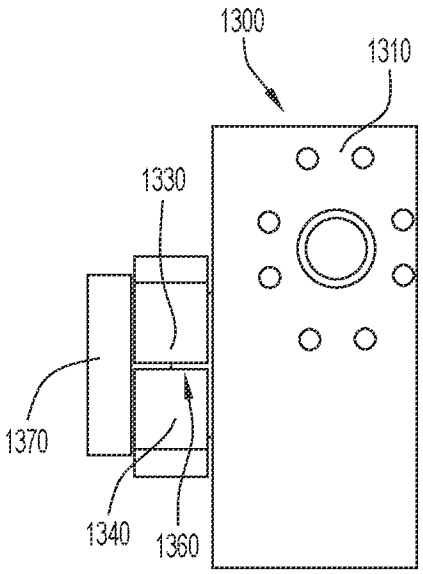
FIG. 30 is an end view of the fluid end illustrated in FIG. 29.
Figure 29:
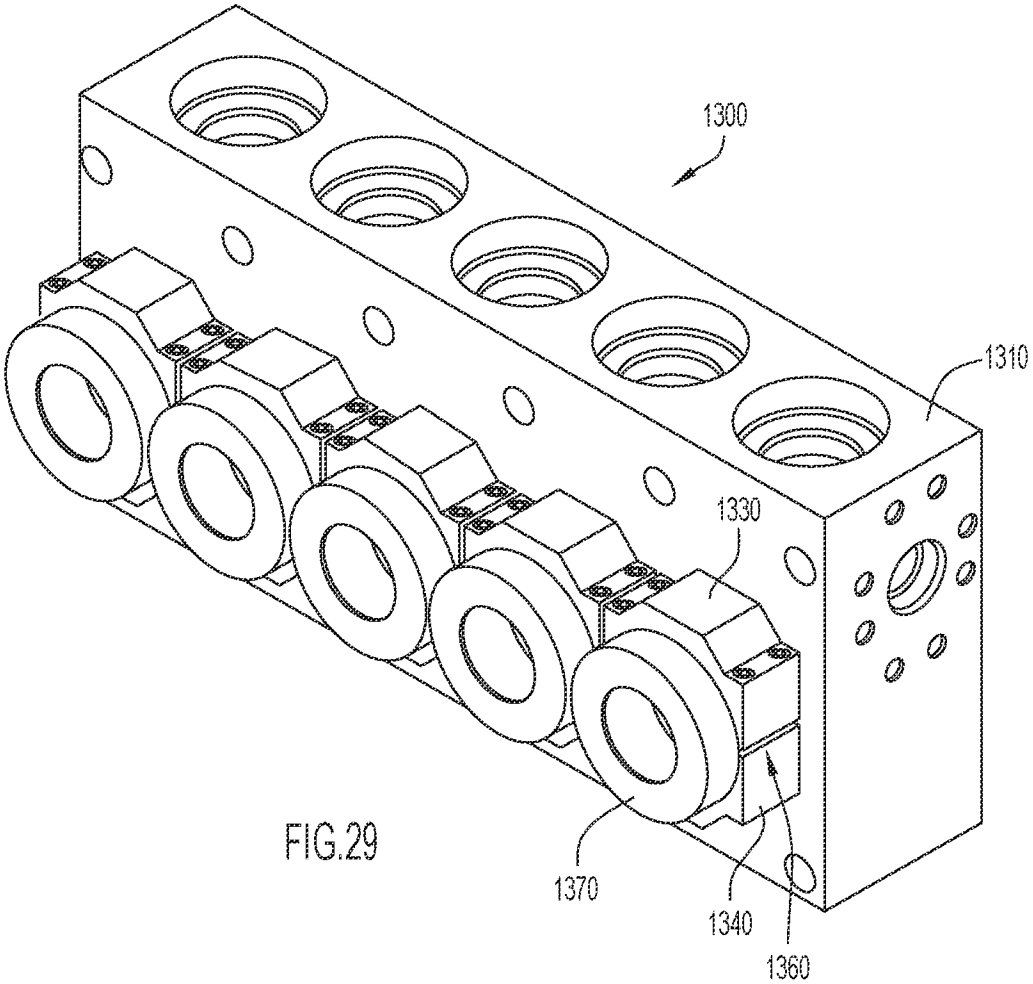
FIG. 29 is a top perspective view of at least a portion of a fluid end of a reciprocating pump according to another example embodiment of the present application, with the retaining assembly in a first configuration.

Referring to FIGS. 29-32, at least a portion of another embodiment of a fluid end according to the present invention is illustrated. In this embodiment, fluid end 1300 includes a casing or housing 1310 that has five reciprocation bores. The fluid end components 1370 for the bores are coupled to the fluid end housing 1310 by clamp members 1330 and 1340. As shown in FIG. 30, a gap 1360 is illustrated between adjacent ends of the clamp members 1330 and 1340. Clamp members 1330 and 1340 are coupled together by connectors and secure the fluid end components 1370 to the fluid end housing 1310 with gap 1360 therebetween.

Figure 32:
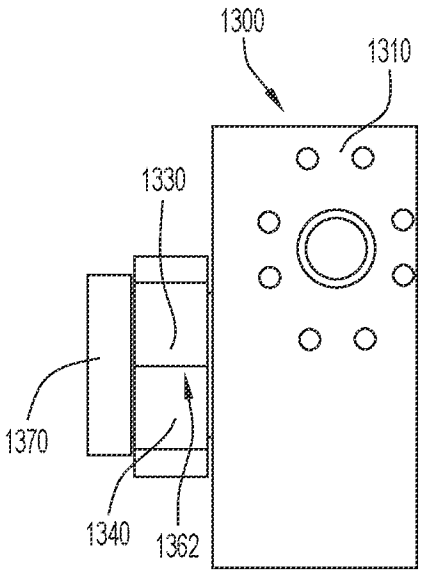
FIG. 32 is an end view of the fluid end illustrated in FIG. 31.
Figure 31:
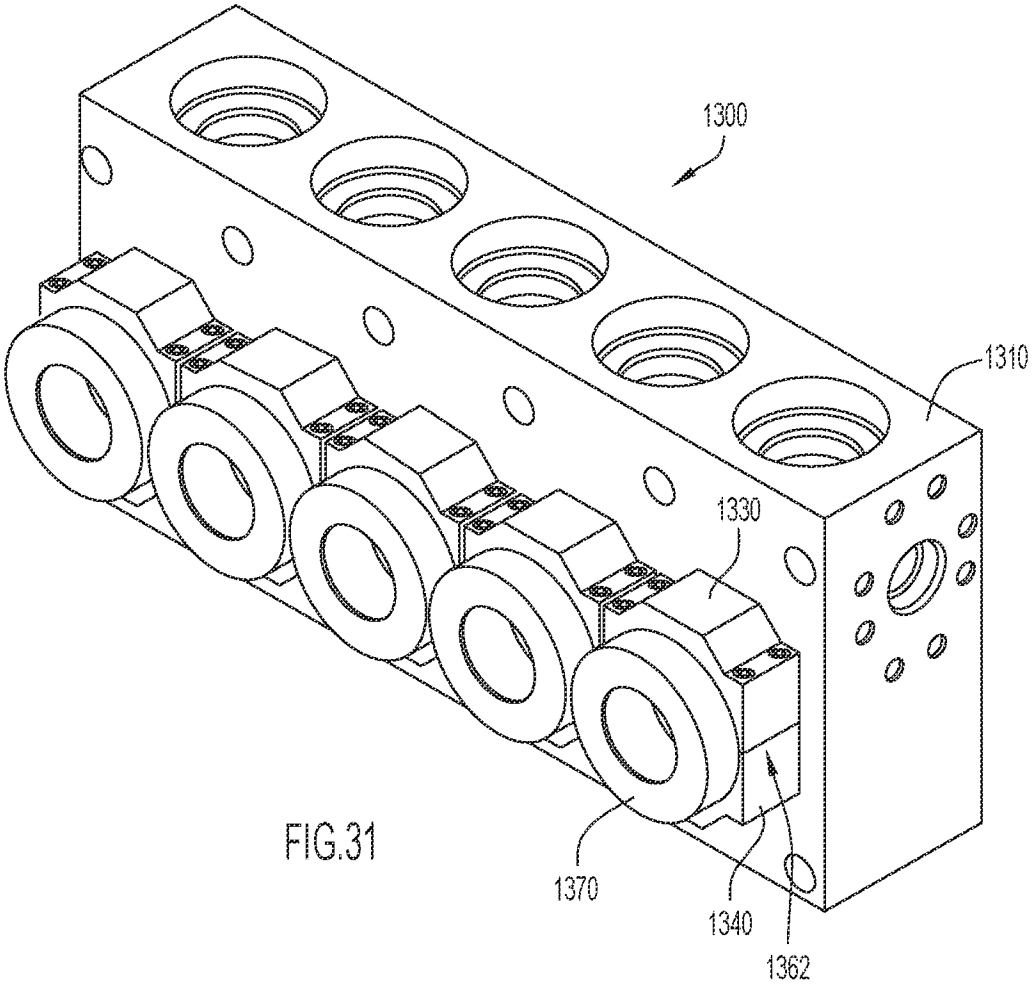
FIG. 31 is a top perspective view of the fluid end illustrated in FIG. 29 with the retaining assembly in a second configuration.

Referring to FIGS. 31 and 32, the connectors coupling the clamp members 1330 and 1340 have been tightened to minimize or eliminate the gap 1362. In this orientation, the wedge-shaped grooves in the clamp members 1330 and 1340 apply a pre-load force or tension to the flanges of the fluid end component and the fluid end housing.

While the invention has been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

Similarly, it is intended that the present invention cover the modifications and variations of this invention that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Finally, when used herein, the term "comprises" and its derivations (such as "comprising", etc.) should not be understood in an excluding sense, that is, these terms should not be interpreted as excluding the possibility that what is described and defined may include further elements, steps, etc. Meanwhile, when used herein, the term "approximately" and terms of its family (such as "approximate," etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially."

What is claimed is:

1. A reciprocating pump, comprising: a power end configured to generate pumping power; a fluid end having a casing with an inlet bore and an outlet bore, the fluid end being configured to deliver a fluid from the inlet bore to the outlet bore as the power end generates the pumping power, the fluid end casing including a first bore formed therein, the first bore having a first coupling feature on an inner surface associated therewith; a mounting component including a body portion and a first mounting portion, the body portion and the first mounting portion being a unitary body, the body portion having a second coupling feature on an outer surface, the second coupling feature being engageable with the first coupling feature on the fluid end casing to couple the mounting component to the fluid end casing; a fluid end component that is couplable with the mounting component, the fluid end component including a second mounting portion; and a retainer assembly engageable with the first mounting portion and the second mounting portion, the retainer assembly applying a force to each of the first mounting portion and the second mounting portion to press the first mounting portion and the second mounting portion toward each other, the retainer assembly including a pair of spaced apart rails, the pair of spaced apart rails defining a wedge-shaped groove that increases pressure on the first mounting portion and on the second mounting portion as the retainer assembly is tightened.

2. The reciprocating pump of claim 1, wherein the first coupling feature is a first set of threads, and the second coupling feature is a second set of threads.

3. The reciprocating pump of claim 1, wherein the first bore has an inner surface with the first coupling feature formed therein.

4. The reciprocating pump of claim 3, wherein the first coupling feature is a first set of threads that are formed in the inner surface of the first bore.

5. The reciprocating pump of claim 1, wherein the body portion of the mounting component has an outer surface that has the second coupling feature.

6. The reciprocating pump of claim 5, wherein the second coupling feature is a second set of threads that are formed on the outer surface of the body portion.

7. The reciprocating pump of claim 6, wherein the first coupling feature is a first set of threads that are formed in an inner surface of the first bore.

8. The reciprocating pump of claim 1, wherein the wedge-shaped groove is defined by a continuous curved surface that extends from one end on one of the pair of spaced apart rails to an opposite end on the other of the pair of spaced apart rails, and the wedge-shaped groove has a width that is less than a width of the first mounting portion and the second mounting portion together.

9. The reciprocating pump of claim 1, wherein the retainer assembly includes a first clamp member and a second clamp member, the first clamp member includes a body having an inner surface and an outer surface opposite to the inner surface, the inner surface includes the pair of spaced apart rails, the pair of spaced apart rails includes a first rail and a second rail, and the first clamp member includes a groove formed between the first rail and the second rail.

10. The reciprocating pump of claim 1, wherein the first mounting portion of the fluid end casing includes a first flange, the second mounting portion of the fluid end component includes a second flange, and the retainer assembly includes a first clamp member and a second clamp member, each of the first clamp member and the second clamp member includes a first rail and a second rail defining a groove therebetween, the grooves receiving the first flange and the second flange when the clamp members are coupled together, and each of the first clamp member and the second clamp member has a wedge-shaped geometry.

11. The reciprocating pump of claim 1, wherein the retainer assembly includes a first clamp member and a second clamp member, the first clamp member has a first rail with a first angled surface and a first curved surface and a second rail with a second angled surface and a second curved surface, and the first angled surface, the first curved surface, the second angled surface, and the second curved surface collectively defining a groove therebetween.

12. The reciprocating pump of claim 1, wherein the fluid end component is a flanged stuffing box, a portion of the flanged stuffing box is locatable in the fluid end casing, and the first mounting portion is a first flange coupled to the fluid end casing, the second mounting portion is a second flange extending from the flanged stuffing box, and the retainer assembly couples the first flange to the second flange.

13. A fluid end of a reciprocating pump, comprising: a casing defining a fluid cylinder, the casing including a first bore formed therein, the first bore having a first coupling feature on an inner surface associated therewith, the casing having a mounting component coupled thereto, the mounting component including a second coupling feature on an outer surface that engages the first coupling feature to couple the mounting component to the casing, the mounting component being a single body including a body portion and a first mounting portion; a fluid end component configured to engage the fluid cylinder, the fluid end component including a second mounting portion, the first mounting portion and the second mounting portion collectively forming a joint; and a coupling assembly that engages the first mounting portion and the second mounting portion, the coupling assembly including a first curved surface portion and a second curved surface portion opposing the first curved surface portion, the first curved surface portion engages the first mounting portion, the second curved surface portion engages the second mounting portion, the first curved surface portion and the second curved surface portion along with a curved lower surface collectively forming a wedge-shaped groove therebetween, and both of the first curved surface portion and the second curved surface portion applying an increasing pre-load compression to the joint formed by the first mounting portion and the second mounting portion as the coupling assembly is tightened from a coupling position to a pre-load applying position.

14. The fluid end of claim 13, wherein the first bore has an inner surface, the first coupling feature is a first set of threads formed on the inner surface of the first bore, the body portion of the mounting component has an outer surface, the second coupling feature is a second set of threads formed on the outer surface of the body portion, and the second set of threads engage the first set of threads to couple the mounting component to the casing.

15. The fluid end of claim 13, wherein the wedge-shaped groove has a width that is less than a width of the first mounting portion and the second mounting portion together.

16. The fluid end of claim 13, wherein the coupling assembly includes a first clamp member and a second clamp member, the first clamp member includes a body having a first rail and a second rail that define part of the wedge-shaped groove therebetween.

17. The fluid end of claim 13, wherein the coupling assembly includes a first clamp member having the first curved surface portion and a second clamp member having the second curved surface portion.

18. The fluid end of claim 17, wherein the first clamp member has a first rail with a first angled surface and a first curved surface and a second rail with a second angled surface and a second curved surface, and the first angled surface, the first curved surface, the second angled surface, and the second curved surface collectively defining part of the wedge-shaped groove therebetween.

19. A fluid end of a reciprocating pump, comprising: a casing defining a fluid cylinder, the casing including a first bore having a first coupling feature on an inner surface associated therewith, the casing having a mounting component coupled thereto, the mounting component including a second coupling feature on an outer surface that engages the first coupling feature to couple the mounting component to the casing, the mounting component including a body portion and a first flange extending from the body portion, the body portion including the second coupling feature formed thereon; a fluid end component configured to engage the fluid cylinder, the fluid end component including a second flange extending therefrom; and a clamping assembly having a first clamp member and a second clamp member coupleable to the first clamp member, the first clamp member having a first clamp rail and a second clamp rail that define a first wedge-shaped groove therebetween configured to receive the first flange and the second flange, the first clamp rail and the second clamp rail being configured so that the wedge-shaped groove forces the first flange into engagement with the second flange to apply a pre-load force thereto, wherein an amount of pre-load force applied to the first flange and the second flange is determined by how far the first flange and the second flange extend into the wedge-shaped groove.

20. The fluid end of claim 19, wherein the first bore has an inner surface, the first coupling feature is a first set of threads formed on the inner surface of the first bore, the body portion of the mounting component has an outer surface, the second coupling feature is a second set of threads formed on the outer surface of the body portion, and the second set of threads engage the first set of threads to couple the mounting component to the casing.

* * * * *